US006884065B2

(12) United States Patent
Vandrak et al.

(10) Patent No.: US 6,884,065 B2
(45) Date of Patent: Apr. 26, 2005

(54) GAS FIRED PORTABLE UNVENTED INFRARED HEATER

(75) Inventors: Brian S. Vandrak, Highland Heights, OH (US); John D. DuRoss, Jr., Chagrin Falls, OH (US); Allan L. Haire, Garfield Heights, OH (US)

(73) Assignee: Mr. Heater, Inc., Cleveland, OH (US)

( * ) Notice: Subject to any disclaimer, the term of this patent is extended or adjusted under 35 U.S.C. 154(b) by 0 days.

(21) Appl. No.: 10/605,486

(22) Filed: Oct. 2, 2003

(65) Prior Publication Data

US 2004/0106080 A1 Jun. 3, 2004

Related U.S. Application Data

(63) Continuation-in-part of application No. 10/051,561, filed on Jan. 18, 2002, now Pat. No. 6,648,635, which is a continuation of application No. 09/731,156, filed on Dec. 6, 2000, now Pat. No. 6,340,298.

(60) Provisional application No. 60/169,062, filed on Dec. 6, 1999.

(51) Int. Cl.[7] ..... F24H 1/06

(52) U.S. Cl. ..... 432/222; 126/91 R; 126/110 B; 126/110 C; 431/328

(58) Field of Search ..... 432/222, 219, 432/223; 126/92 B, 92 AC, 91 R, 104 A, 110 A, 110 C, 110 B; 431/261, 80, 328, 345

(56) References Cited

U.S. PATENT DOCUMENTS

| | | | | |
|---|---|---|---|---|
| 1,639,780 A | | 8/1927 | Mulholland | |
| 3,139,879 A | | 7/1964 | Bauer et al. | |
| 3,590,806 A | | 7/1971 | Locke | |
| 3,814,573 A | * | 6/1974 | Karlovetz | 431/329 |
| D243,694 S | | 3/1977 | Faulkner | |

(Continued)

FOREIGN PATENT DOCUMENTS

| | | | | |
|---|---|---|---|---|
| GB | 253043 | | 6/1926 | |
| JP | 354116747 A | * | 9/1979 | 431/80 |
| JP | 35551233 A | * | 4/1980 | 431/80 |

OTHER PUBLICATIONS

O'Meara Camping Centers (web page), Cookers & Heaters, "Alvima Carasol 3b Heater", data sheets pp. 1–7, Jun. 26, 2002.

Dynamx Incorporated Warehouse Appliance (web page), Williams Heaters—Vent–Free Home Models, data sheets pp. 1–4, Jun. 26, 2002.

AGA, American Gas Association, Fact Sheet, "Oxygen Depletion Sensing (ODS) Systems", Dec. 1984.

(Continued)

*Primary Examiner*—Gregory Wilson
(74) *Attorney, Agent, or Firm*—Buckingham, Doolittle & Burroughs, LLP; Louis F. Wagner

(57) ABSTRACT

A portable heater adapted for use in a recreational enclosure or temporary work enclosure includes a housing having an air inlet on the lower front face. A gas supply is partially enclosed by the housing which provides propane to the mouth of a burner venturi located within the housing. Air is drawn through the air inlet and also enters the mouth of the burner venturi. The air and gas are mixed thoroughly as they travel upwardly through the burner venturi. A chimney effect increases fresh air flow velocity into the burner venturi and allows the heater to operate at a reduced fuel gas pressure. Upon exiting the burner venturi, the air/gas mixture is to a plenum and radiant surface where combustion takes place. Any conventional means may be provided to ignite the air/gas mixture in order to cause combustion. The combustion products deflect off a deflector, which is cooled on a rear face by air flow through the housing, which decreases the temperature of the combustion products before exiting an outlet. An oxygen depletion system (ODS) shuts off the portable heater when oxygen levels begin to drop and consequently carbon monoxide levels begin to rise.

146 Claims, 20 Drawing Sheets

U.S. PATENT DOCUMENTS

| | | | | | |
|---|---|---|---|---|---|
| 4,340,362 | A | | 7/1982 | Chalupsky et al. | |
| 4,348,172 | A | | 9/1982 | Miller | |
| 4,640,680 | A | | 2/1987 | Schilling | |
| 4,718,846 | A | * | 1/1988 | Oguri et al. | 431/76 |
| 4,768,947 | A | * | 9/1988 | Adachi | 431/80 |
| 4,782,814 | A | * | 11/1988 | Cherryholmes | 126/92 B |
| 4,843,313 | A | | 7/1989 | Walton | |
| 4,848,313 | A | * | 7/1989 | Velie | 126/110 C |
| 5,090,899 | A | | 2/1992 | Kee | |
| 5,239,979 | A | | 8/1993 | Maurice et al. | |
| 5,645,043 | A | | 7/1997 | Long et al. | |
| D391,345 | S | | 2/1998 | Mandir et al. | |
| 5,838,243 | A | | 11/1998 | Gallo | |
| 5,941,699 | A | | 8/1999 | Abele | |
| 6,227,451 | B1 | * | 5/2001 | Caruso | 237/2 A |
| 6,340,298 | B1 | | 1/2002 | Vandrak et al. | |
| 2002/0058266 | A1 | | 5/2002 | Vandrak et al. | |

OTHER PUBLICATIONS

Bullfinch (Gas Equipment) Limited, The Simba Range Ultra Safe–Low Cost Mobile Cabinet Heaters, 2 pages, undated.

Mobile Gas Supplies, Mobile Heaters, data sheets pp. 1–4, Mar. 6, 2002.

Brians of Sheerness, Valor Fires, data sheets pp. 1–2, Mar. 6, 2002.

Mobile Gas Supplies, Thurcroft Stove, data sheets pp. 1–2, Mar. 6, 2002.

The Coleman Co., Inc., 3000 BTU Propane Catalytic Heater, instructions for use pp. 1–4, undated.

* cited by examiner

GAS FIRED PORTABLE UNVENTED INFRARED HEATER

CROSS REFERENCE TO RELATED APPLICATIONS

This application is a continuation-in-part of U.S. patent application Ser. No. 10/051,561 filed Jan. 18, 2002 now U.S. Pat. No. 6,648,635, which is a continuation application of U.S. patent application Ser. No. 09/731,156, filed on Dec. 6, 2000, now U.S. Pat. No. 6,340,298, which is a non-provisional patent application of U.S. patent application Ser. No. 60/169,062, filed Dec. 6, 1999.

BACKGROUND OF INVENTION

This invention relates generally to improved portable heaters used in relatively small enclosures. More particularly, the invention relates to a uniquely configured propane source infrared heater for use in enclosures such as small recreational enclosures, temporary work enclosures, or vehicles. Although the invention was designed for indoor areas, it will be appreciated that it has broader applications and may be advantageously employed in a wide variety of environments without departing from the scope of the invention.

Gas-fired portable heaters are well known in the art and are used in multiple environments. The heater typically includes a housing having a chamber. The housing has an inlet for receiving air into the chamber. Gas is introduced into the chamber to be mixed with the air in order to complete combustion and provide an infrared heating surface. A plenum directs the heat toward a mesh screen and evenly distributes it over the surface thereof. The overall goal in designing such a unit is to achieve a radiant surface that provides even, stable heating over the entire surface.

The use of such heaters is strictly regulated for outdoor only use due to the emission of carbon monoxide. Prior designs in existing portable units are subject to a wide variety of problems. Most importantly, the prior designs are not safe or certified to operate in small recreational enclosures such as tents, truck-caps, fishing huts, trailers, vans, etc. There are a few reasons why the devices found in the prior art are not adequate to perform in such environments. First, the portable heaters that exist today operate at a high pressure generally on the order of 12 psi. Specifically, the pressure from the propane tank through a regulator is necessarily high in order to achieve adequate gas and air flow. In addition to requiring high pressure, previous designs do not have the ability to pass strict combustion requirements at a high and low firing condition and at a reduced pressure. For example, a new standard developed for this product (CSA International 4.98 US) states that "the appliance shall not produce carbon monoxide in excess of 0.010 (100 ppm) percent in a room with no air changes occurring during combustion of the amount of gas necessary to reduce the oxygen content of the room to 18 percent by volume." In addition, they do not possess an oxygen depletion system ("ODS") (Capreci/Part No. 21500). These shortcomings have prevented the portable heaters found in the prior art from adequately performing in small recreational and temporary work enclosures.

Therefore, a need exists to provide a portable infrared heater capable of performing safely in small recreational enclosures and temporary work enclosures.

SUMMARY OF INVENTION

This invention contemplates a new and improved burner assembly that is capable of performing safely in small recreational facilities such as tents, truck-caps, vans, fishing huts, trailers, etc.

According to the present invention, a portable heater includes an outer housing having a first or front face, a second or rear face, and two sides interconnecting the front and rear faces. An air inlet is located on the front face of the housing, preferably along a lower portion thereof. A gas supply or tank is partially enclosed and supported by the outer housing. A burner venturi, having a cylindrical body extending upwardly at a slight angle, is disposed within the housing. The burner venturi also has a mouth operatively associated with a bottom end of the cylindrical body. Gas is released from the gas supply into the mouth of the burner venturi. At the same time, air is drawn into the mouth of the burner venturi from the air inlet. The air and gas mix thoroughly as they travel upwardly through the burner venturi.

Upon exiting the burner venturi, a baffle directs the air/gas mixture into a plenum to further mix, enter a rear face of a radiant surface, and then ignited on a top surface where combustion occurs. Any conventional means for initially sparking or igniting the air/gas mixture at the burner surface can be used. The burner plenum is heated to an elevated temperature and the radiant surface emits heat to the ambient environment. Combustion products are directed off a deflector shield which reduces the temperature of the products before exiting an outlet at an upper portion of the housing.

The air inlet of the present invention is advantageously designed to provide air flow along the hot burner plenum resulting in an increased velocity of air flow to the burner venturi. As the burner venturi is heated, the thermal properties result in the air/gas mixture passing upwardly through the angled burner venturi creating a chimney type effect. The chimney effect created by the present invention increases the air flow velocity into the burner venturi. In addition, the device reduces pressure from the gas supply and has the ability to satisfy combustion requirements at low fire condition.

These and other objects of the present invention will become more readily apparent from a reading of the following detailed description taken in conjunction with the accompanying drawings wherein like reference numerals indicate similar parts, and with further reference to the appended claims.

BRIEF DESCRIPTION OF DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION

Figure 1:
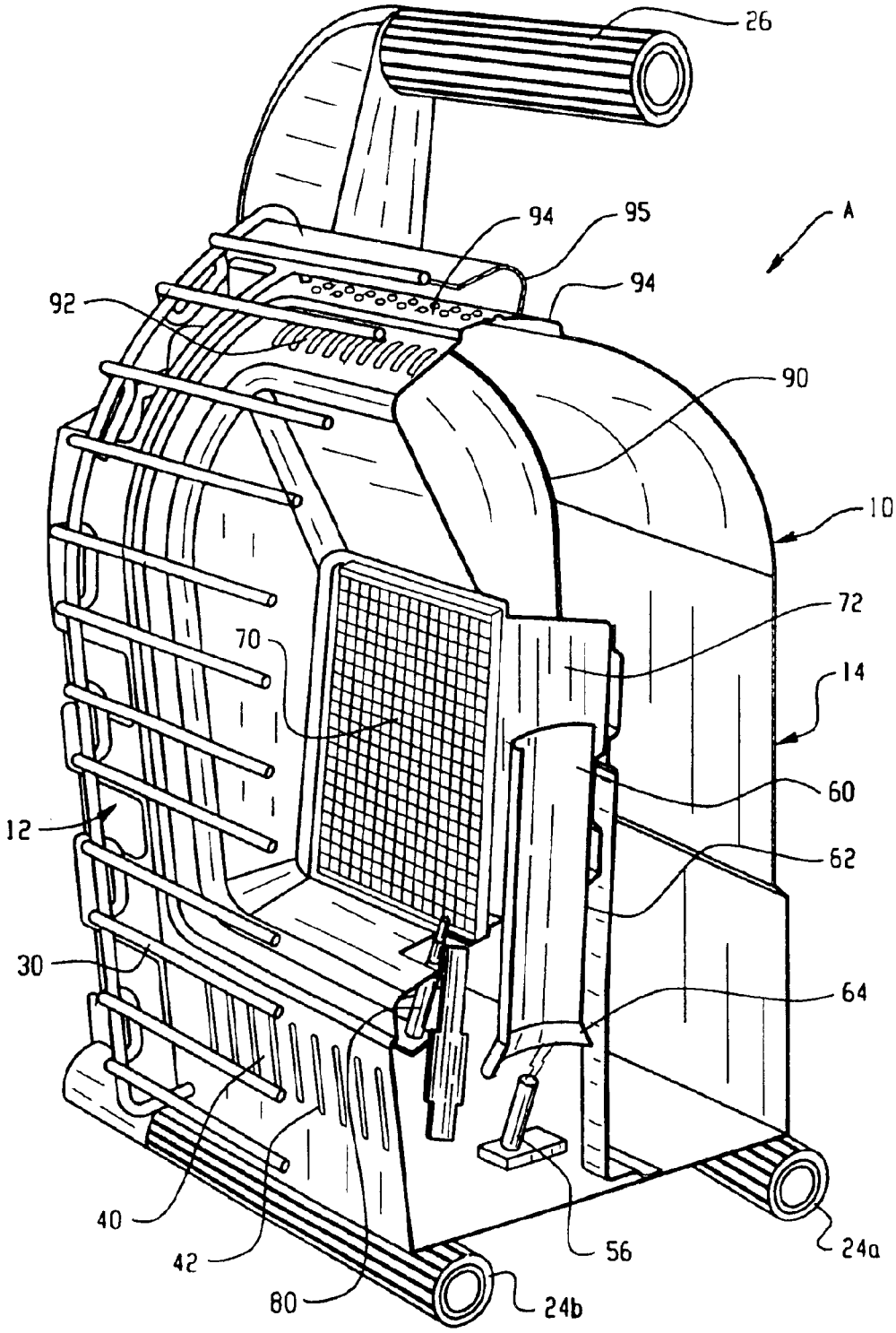
FIG. 1 is a perspective cross-sectional view of a heater assembly in accordance with the teachings of the present invention.

Referring now to the drawings wherein the showings are for purposes of illustrating the preferred embodiment of the invention only and not for purposes of limiting the same, the Figures show a portable heater for use in confined spaces with various configurations for the positioning of the fuel source(s).

Referring now to the drawings wherein the showings are for purposes of illustrating the preferred embodiment of the invention only, and not for purposes of limiting same, the FIGURES show a portable heating device A adapted for use in small enclosed environments. Although the present invention is designed for use in recreational enclosures and temporary work enclosures, it will be appreciated that other uses are contemplated.

The portable heater A includes a housing 10 having a front face 12, a rear face 14, and two sides 16, 18. The housing 10 is preferably manufactured to have smooth contours to prevent snagging or catching of things such as clothing, fabric, etc. A stepped recess or external cavity is formed in an upper front corner region of the left side 16 of the housing 10 for supporting a control knob or temperature controller 20. The recess provides protection against inadvertent contact and accidental changing of the temperature. The temperature controller 20 preferably has four positions: off, pilot, low, and high (not shown) although continuously variable positions for infinitely variable heating is also contemplated within the scope of this invention. Controller may incorporate a piezo spark igniter integral to controller stem rotation.

Another recess is disposed on the upper back corner of the left side 16 of the housing 10. This recess supports an igniter button 22 for activating the heater A. This recess also protects against inadvertent contact with the igniter button 22.

The heater A is supported by two elongated legs 24*a*, 24*b* laterally disposed along the outboard edges of the rear face 14 and front face 12 respectively. The legs 24*a*, 24*b* are preferably grooved providing a friction surface to contact the supporting surface and preferably extend over the entire width of the housing to provide a wide "footprint" and stable support area for the heater. In another embodiment (not shown), additional legs extending front to rear are provided beneath legs 24*a*, 24*b* to increase air flow beneath the heater. A handle 26 is recessed from and extends from the top of the heater at an angle directed away (approximately 15°) from the front face 12. The offset allows the handle to remain cool for handling by a user while the angled orientation of the handle 26 protects the user's hand from heat exiting the top of the heater while the user transports the heater. The handle 26 is optionally grooved providing an enhanced gripping surface for the user.

A shield or metal grid 30 is attached to the front face 12 of the heater to provide protection to the heater components. In addition, the shield prevents accidental contact with the hot portions of the heater front face 12. The shield is preferably made from elongated wire metal strips and peripheral pieces are received in openings 32 in the housing to secure the shield to the heater. In addition, only one screw (not shown) need be removed for access to the interior components enabling easy servicing or replacement of selected components of the heater. Two keyhole openings or recesses 34*a*, 34*b* are located on the upper portion of the back face 14 of the heater allowing the user to hang the heater in an elevated position.

An opening or air inlet 40 is disposed on a lower portion of the front face 12 of the heater for receiving and filtering air drawn into the housing. The air inlet 40 is preferably formed from a series of elongated slits 42 equispaced across the housing beneath the shield. However, any opening that adequately provides air inflow is within the scope of the present invention.

Figure 5:
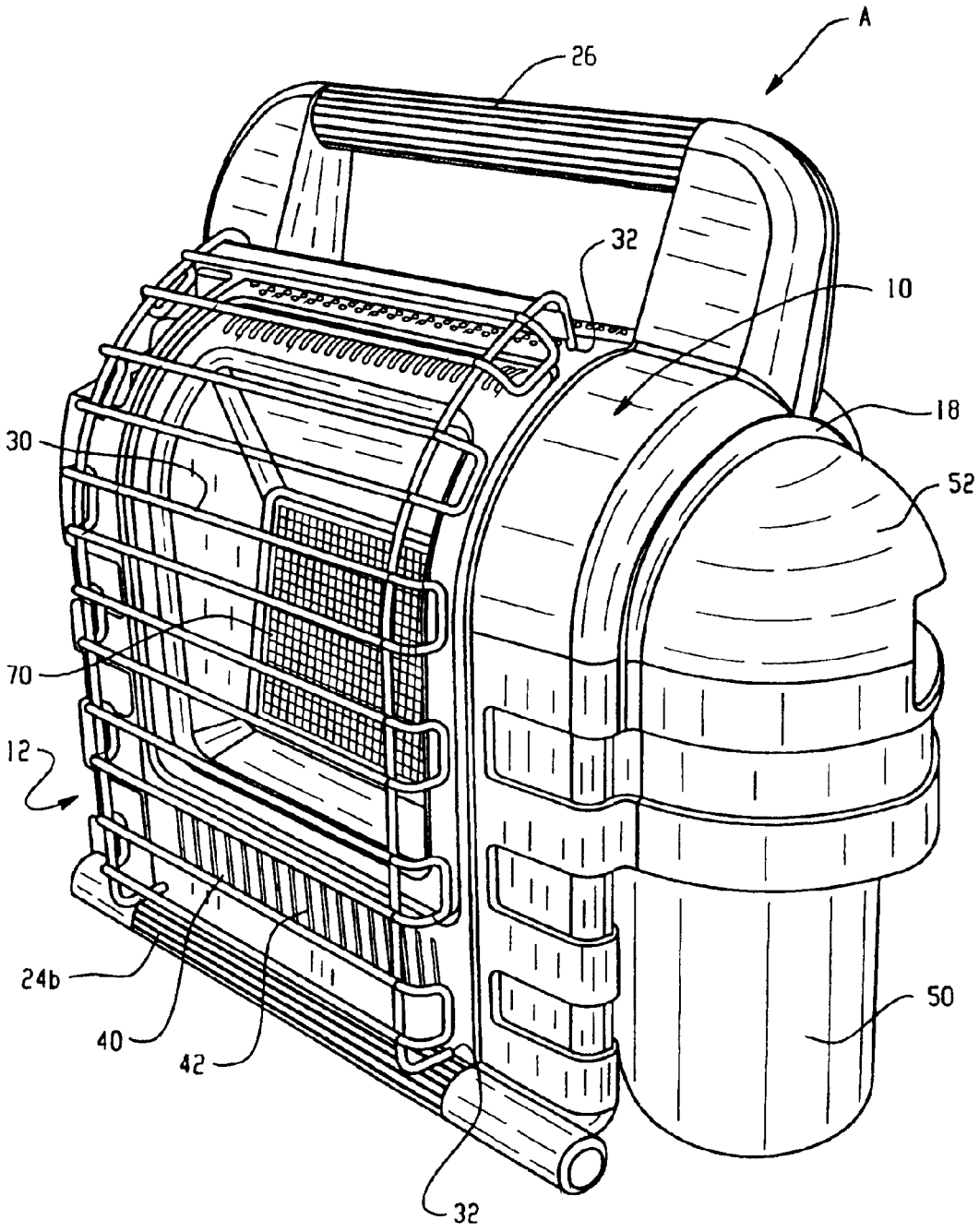
FIG. 5 is a perspective view of the heater taken generally from the front and right-hand side.
Figure 6:
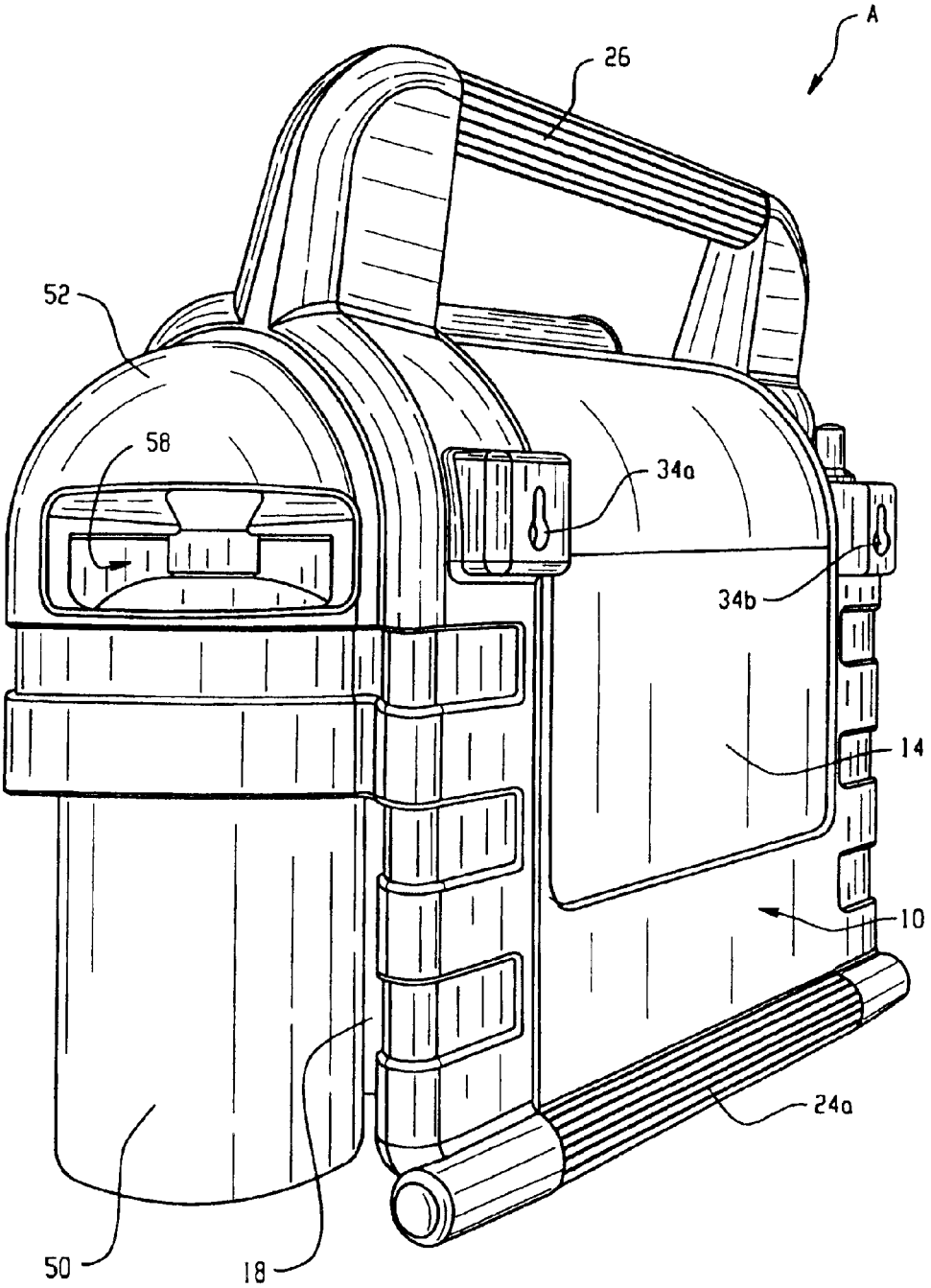
FIG. 6 is a perspective view of the heater taken generally from the rear and right-hand side.
Figure 7:
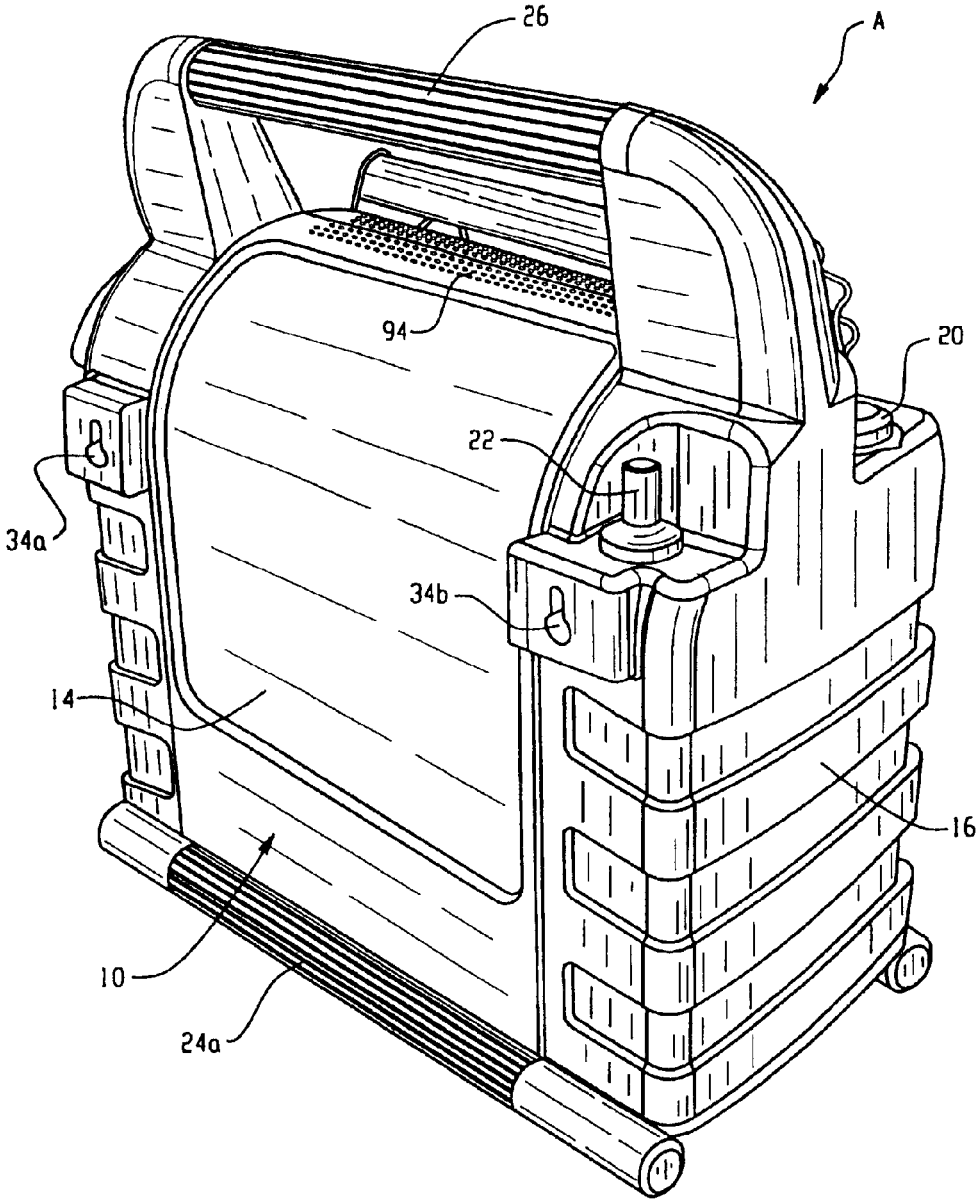
FIG. 7 is a perspective view of the heater taken generally from the rear and left-hand side.
Figure 8:
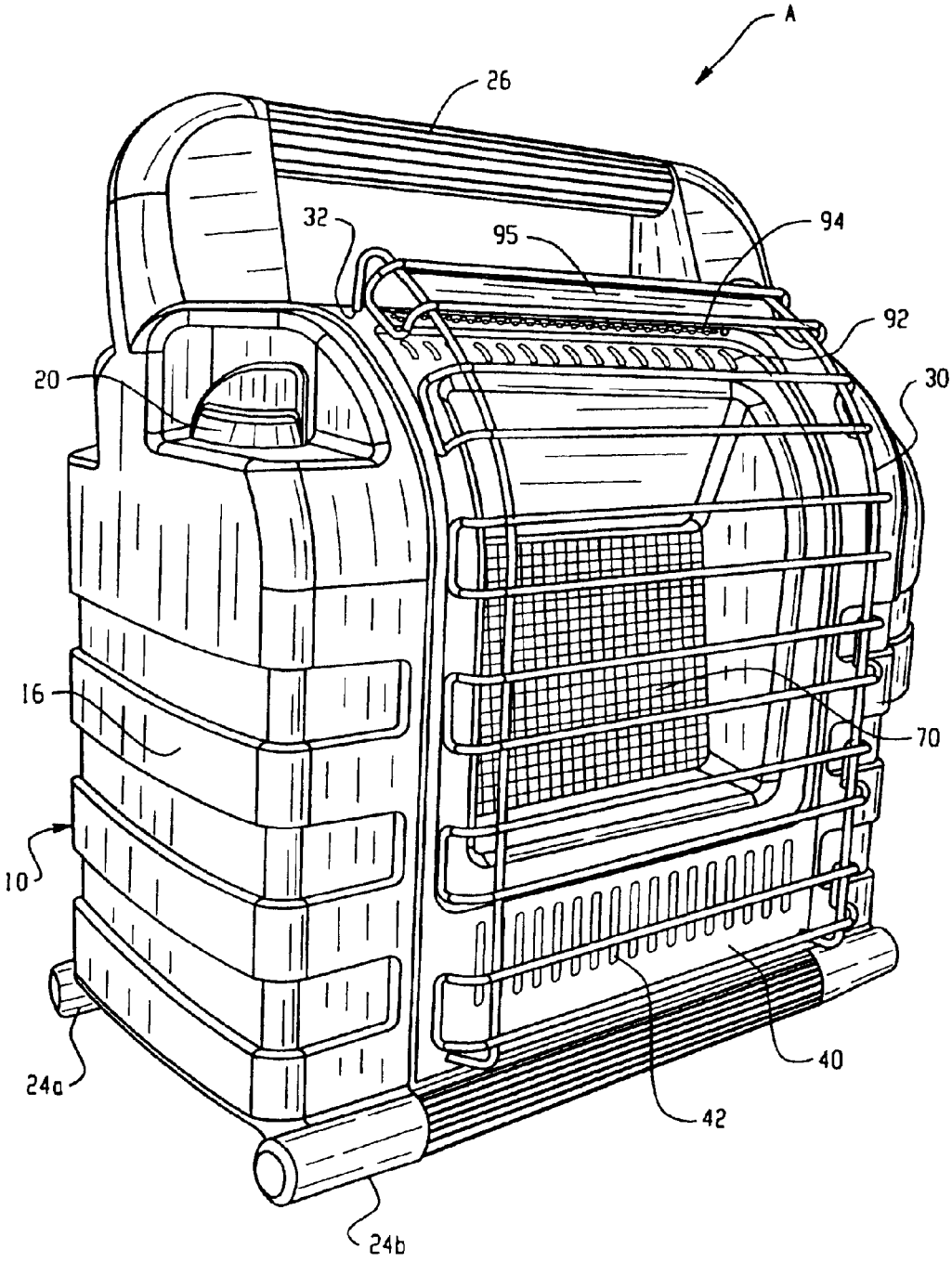
FIG. 8 is a perspective elevational view of the heater in accordance with the present invention.
Figure 9:
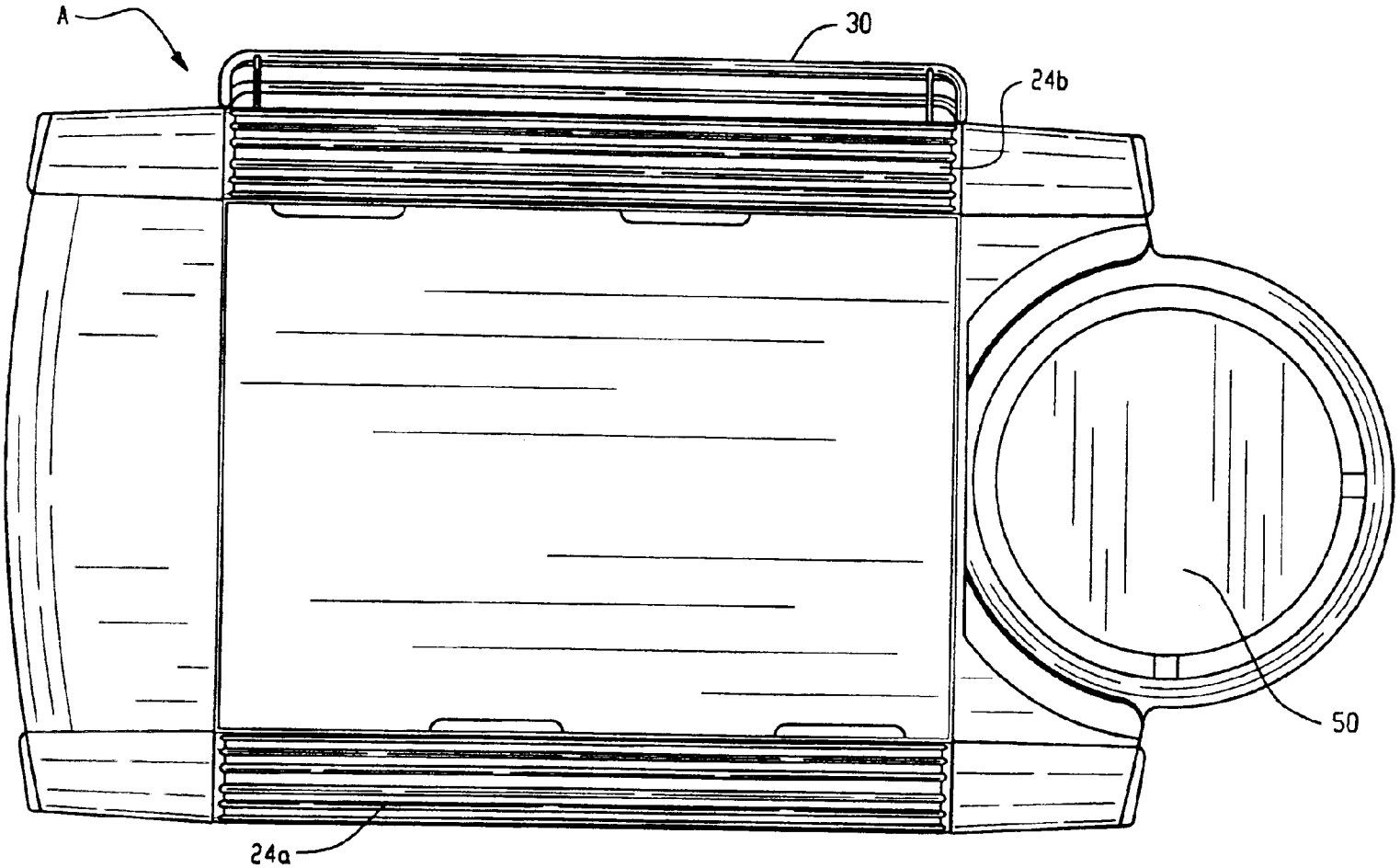
FIG. 9 is a bottom view of the portable heater.
Figure 10:
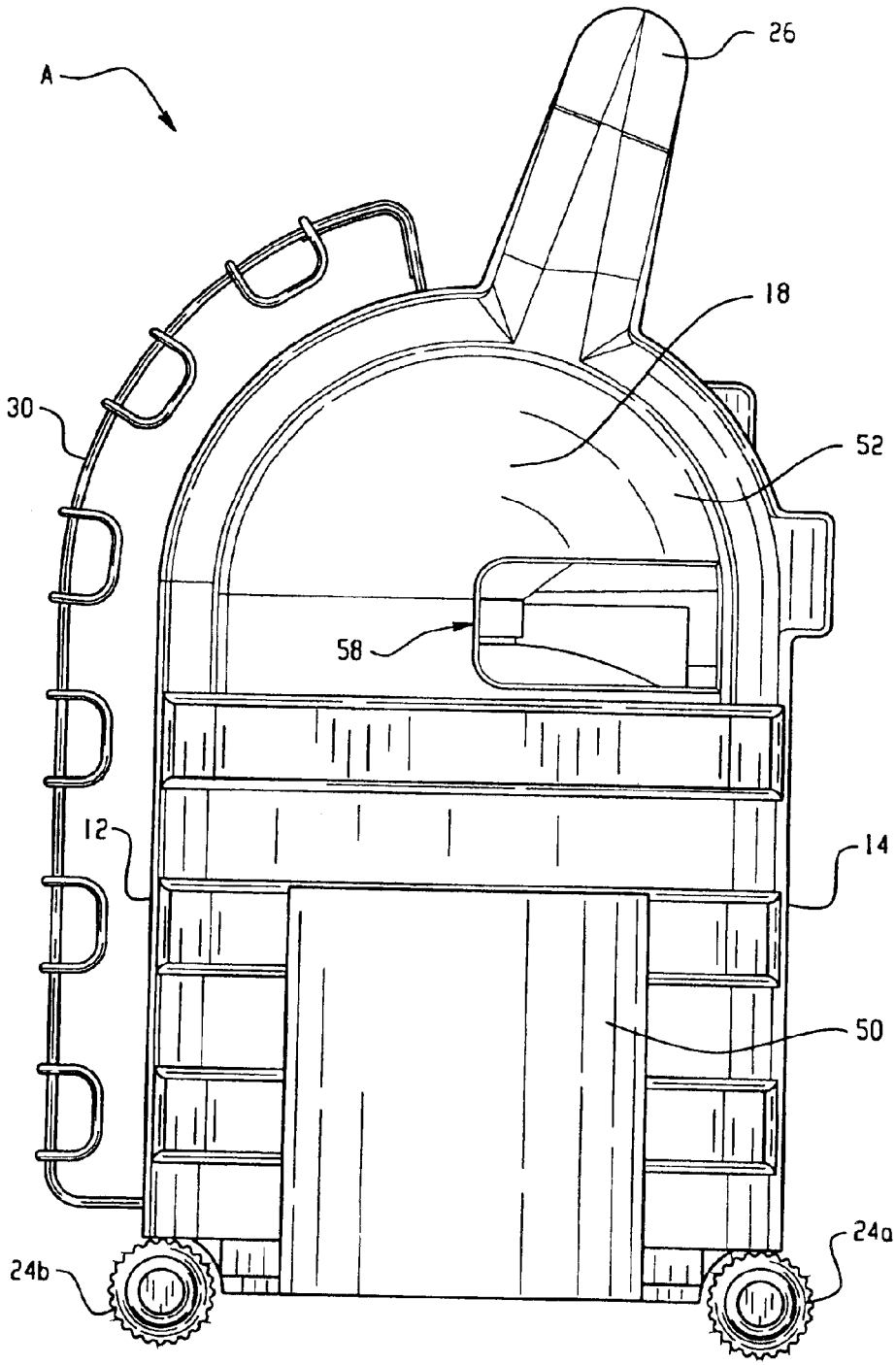
FIG. 10 is a side elevational view of the portable heater.
Figure 11:
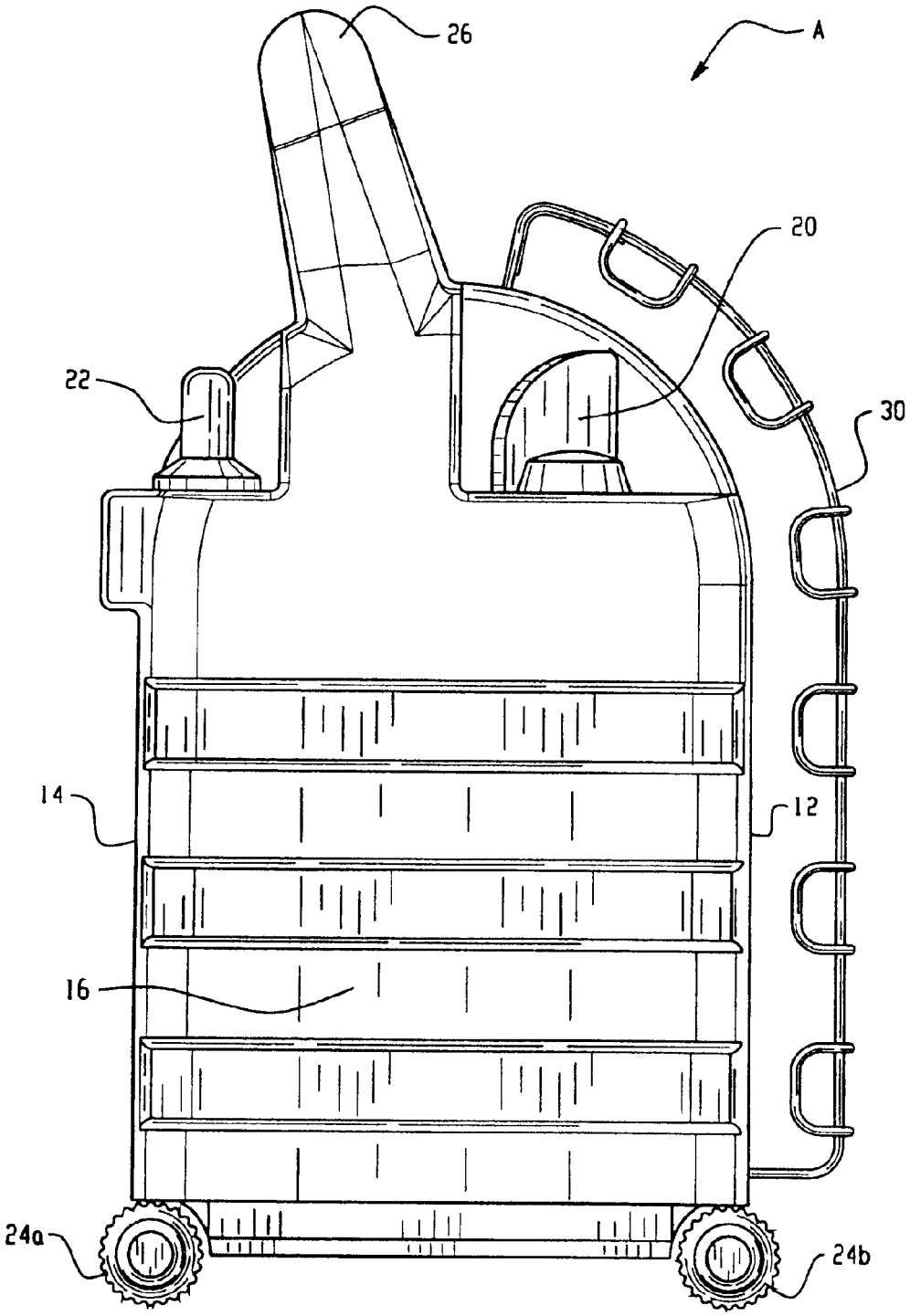
FIG. 11 is a side elevational view of the portable heater.
Figure 12:
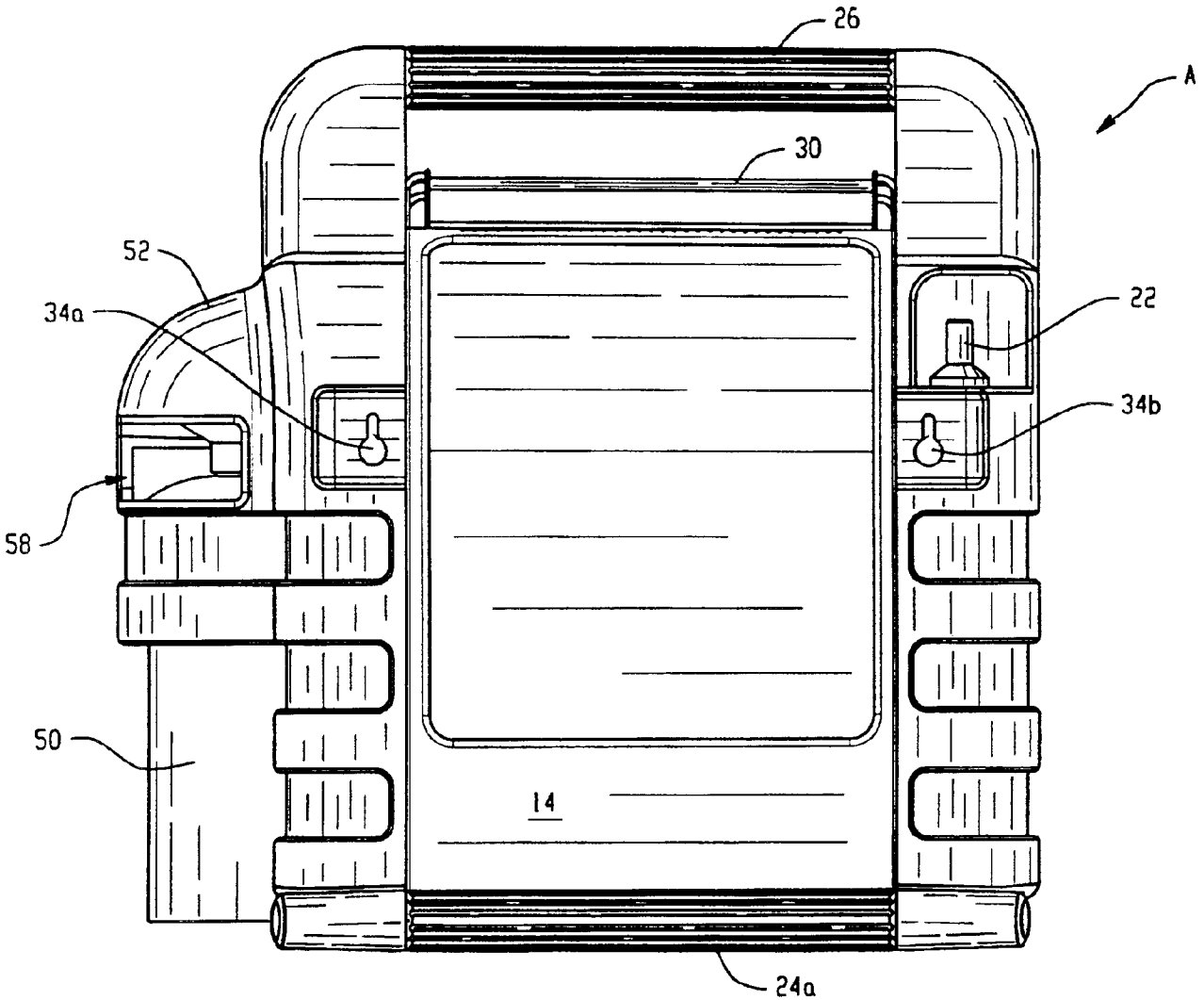
FIG. 12 is a rear elevational view of the portable heater.
Figure 13:
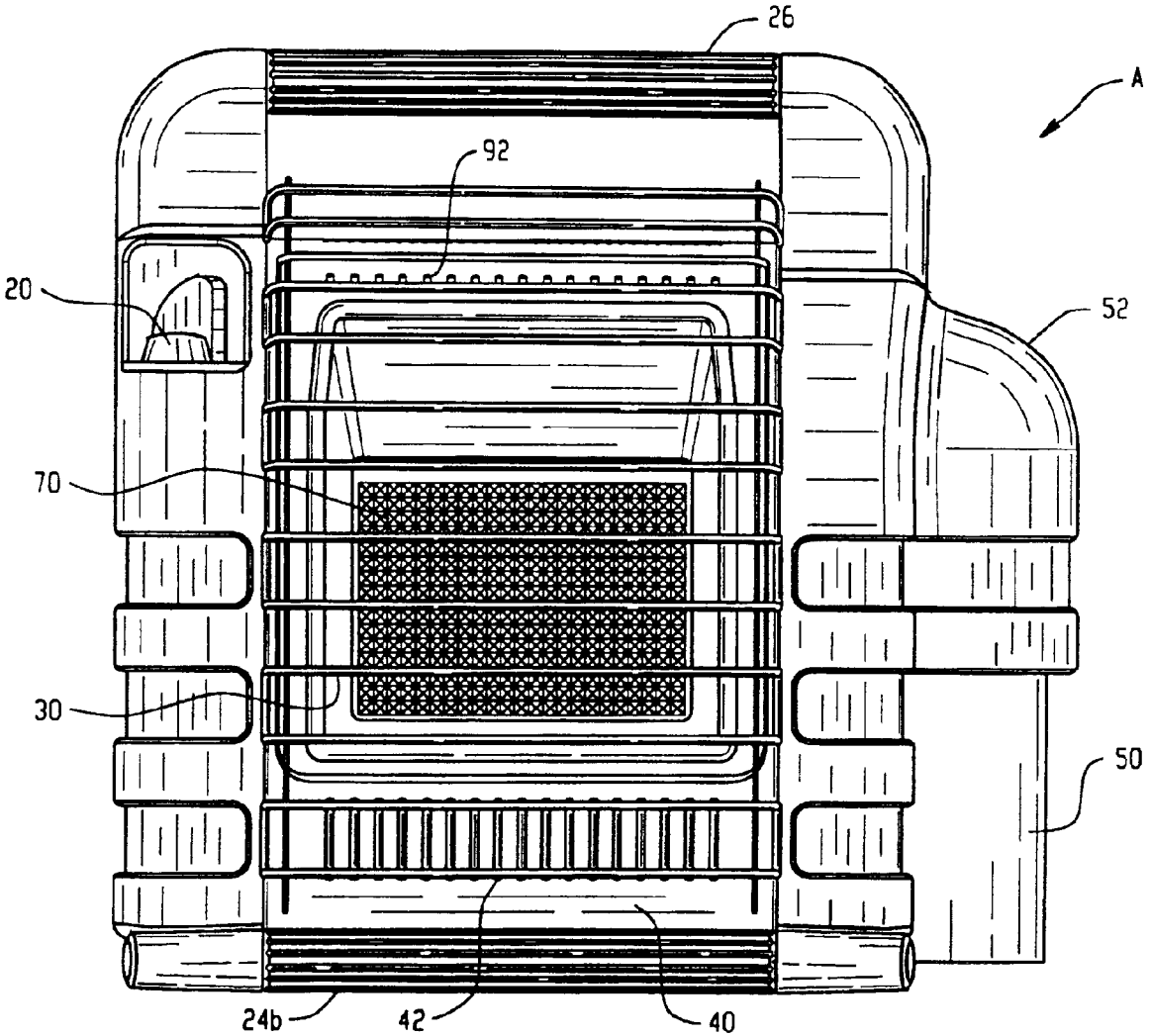
FIG. 13 is a front elevational view of the portable heater.
Figure 14:
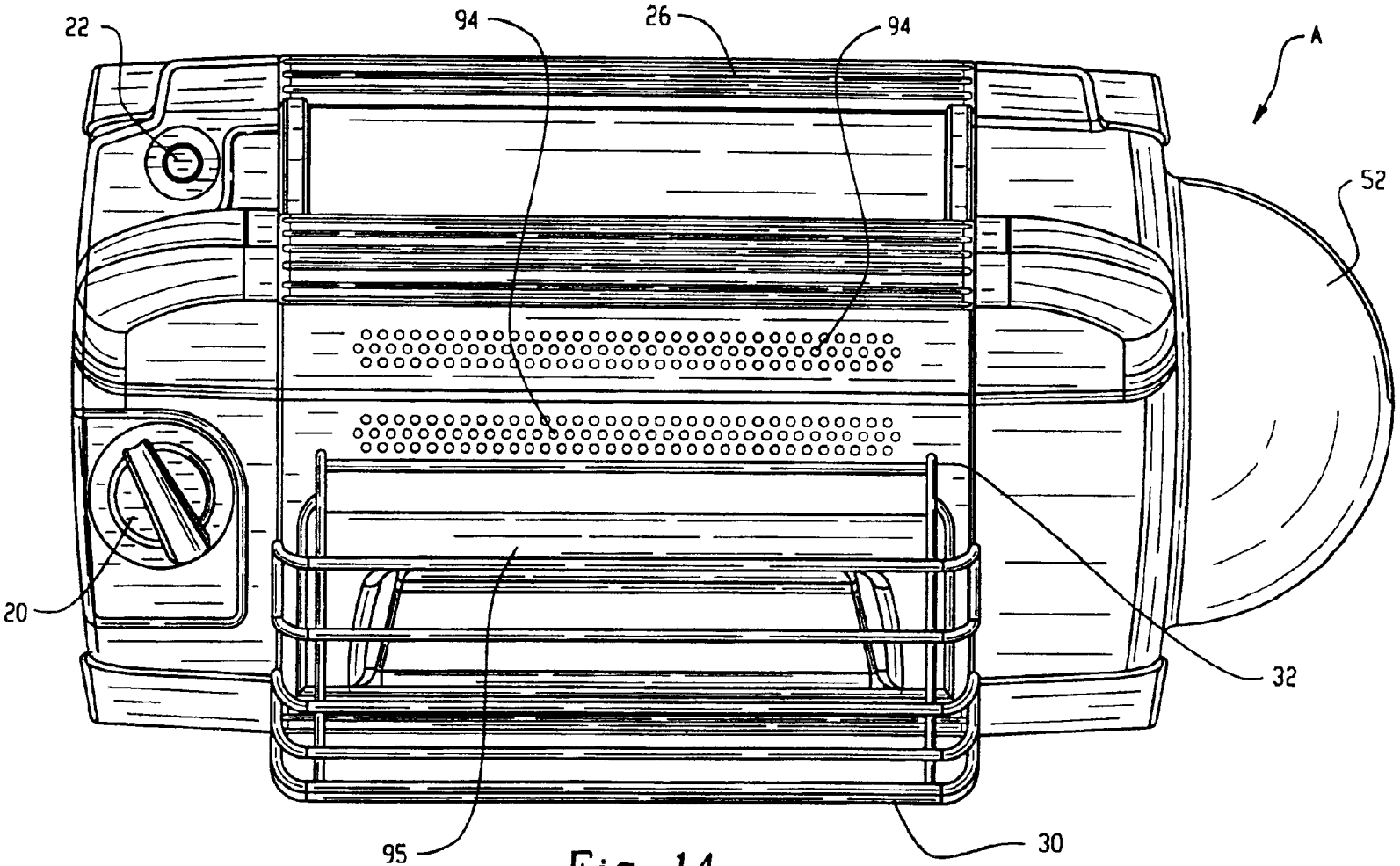
FIG. 14 is a top view of the portable heater.

An LP ("Liquified Petroleum" or "Liquified Propane") gas supply tank 50 is secured to and partially enclosed by the housing 10 (See FIGS. 5 and 6). The LP gas supply 50 is preferably a removable canister or propane tank that can be replaced by a new tank or removed, refilled, and re-installed in the housing. A conical dome 52 protrudes from the side 18 of the housing 10 and partially encloses the gas supply tank 50. The dome acts as a protective shroud to cover the interconnection of the tank with the housing. For example, a one pound propane cylinder may be connected to the housing to provide approximately six hours of continuous operation on the low setting. Alternatively, the heater can be supplied, for example, by a conventional twenty pound propane tank having an extended length hose assembly so that the tank can be located away from the heated region. For instance, the propane tank can be positioned outside a tent, cabin, fishing shanty garage, etc. while the heater is located within the structure and the heater provide on the order of one hundred and ten hours of heat with the larger gas supply tank.

Figure 27:
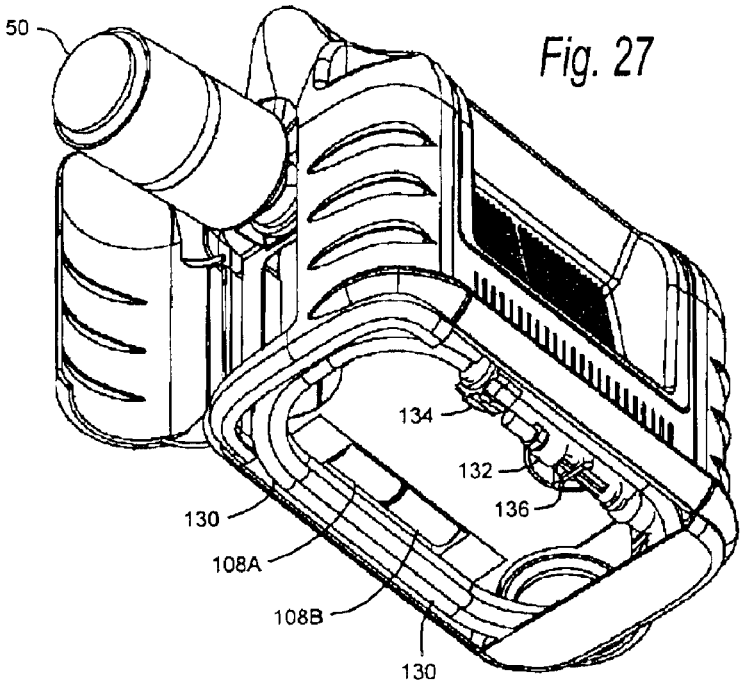
FIG. 27 is a bottom perspective view illustrating the optional remote LP gas supply hose in a coiled configuration.

The gas supply 50 is connected to a regulator which connects to a valve and orifice 56 (See FIG. 1) which is selectively adjustable between open and closed positions, access being provided to the regulator through window opening 58 for remote LP gas supply hose tightening and leak checking (see FIG. 6). Optionally the LP gas supply hose 130 with connector fittings 132, 134 is stored underneath the unit within receptacles 136 in combination with side ledges 138 illustrated in FIG. 27. It is recognized that the LP couplings may be "quick connects" when the supply pressure is already regulated to about 11" water column. In this embodiment, the quick-coupler hose is integral to the heater and downstream from heater regulator(s) but before the control valve to facilitate connection to a regulated hose supply from an external fuel source such as a 20 pound cylinder. Similarly, the regulated fuel supply (11" water column) could originate from a self-contained system as in a recreational vehicle. The quick-coupler hose connection would incorporate positive fuel shut-off in both male and female connection components to prevent fuel escape when disconnected.

Figure 2:
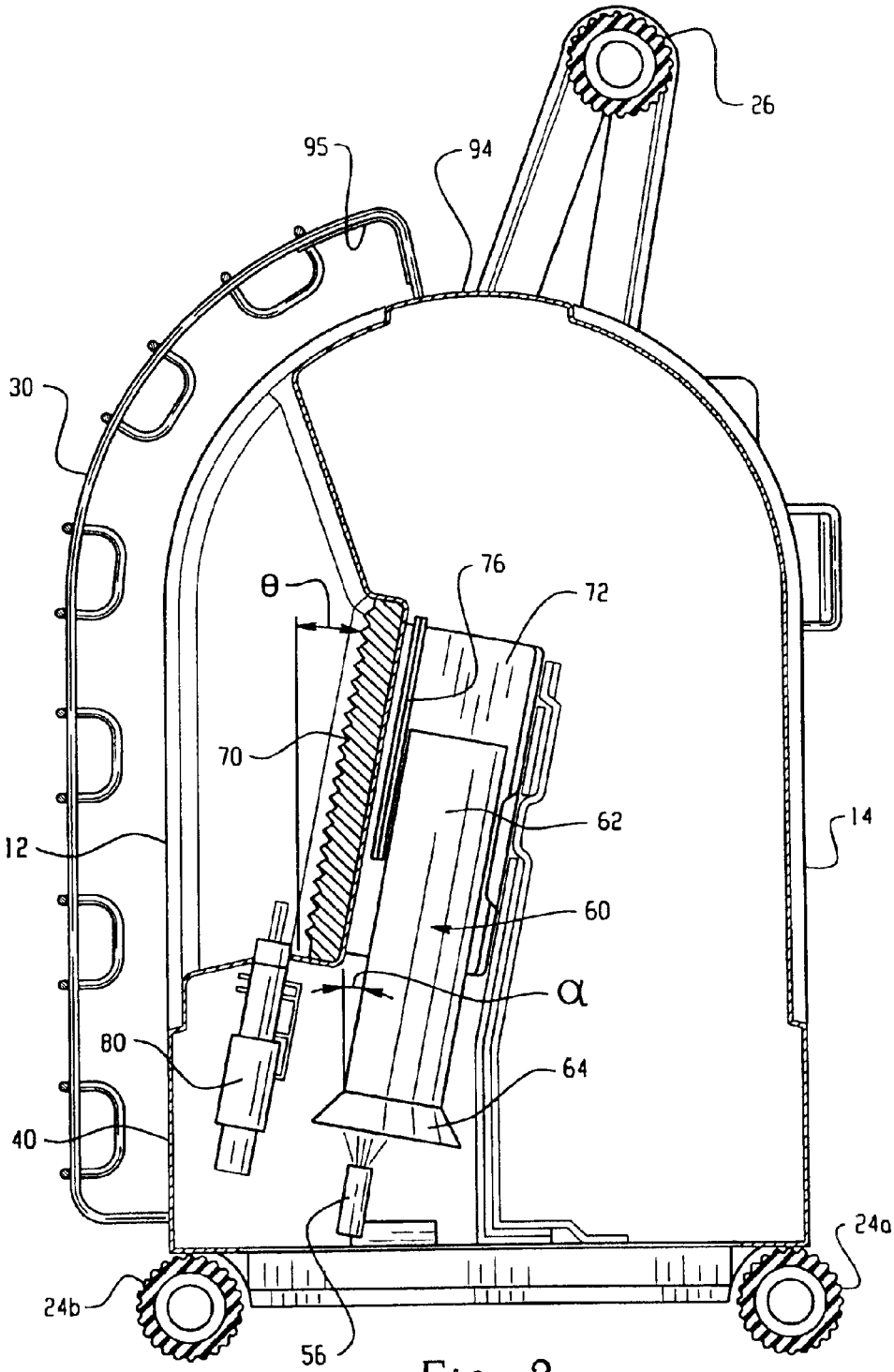
FIG. 2 is a longitudinal cross-sectional view of the heater assembly in accordance with the present invention.

Referring again to FIGS. 1 and 2, a burner venturi 60 is enclosed within the housing 10 and operates to mix oxygen and propane for combustion. The burner venturi 60 has a hollow generally cylindrical body 62 and a tapered mouth 64 having a wider diameter than the body 62. The burner venturi is disposed at an angle a relative to the longitudinal axis of the heater A. The mouth 64 of the burner venturi is positioned on approximately the same axial plane as the air inlet 40 and the cylindrical body 62 extends upwardly from the mouth 64. The orifice 56 which is attached to the gas supply 50 is located directly beneath the mouth 64 of the burner venturi 60.

Also located within the housing A is a generally planar radiant surface 70 disposed at an angle $\alpha$ relative to the longitudinal axis of the heater. A rear face of the radiant surface is in communication with a cavity or plenum chamber 72. The burner plenum receives the air/gas mixture from the venturi and distributes the mixture over and through the rear face of the radiant surface. Thus, in operation, the orifice 56, attached to the gas supply, is opened releasing a fuel gas such as propane into the mouth 64 of the burner venturi 60. Associated with the orifice is a regulator that reduces the delivery pressure of the fuel gas from the tank (rated up to 150 psi) to eleven inches of water column in one stage. Thus, this portable heater operates at a significantly lower pressure than existing commercially available units. The stream of gas exiting the orifice 56 creates a vacuum effect drawing air from the air inlet 40 into the mouth 64 of the burner venturi. Propane and air are thoroughly mixed in the burner venturi 60 and plenum 72 in order to achieve complete combustion and produce a clean burning infrared heating surface. The mixture of oxygen and propane travels upward through the cylindrical body 62 of the burner venturi 60 until reaching the plenum chamber 72. To prevent the mixture of propane and oxygen from immediately exiting the plenum chamber 72, a solid baffle 76 is provided which forces the air/gas mixture downward into communication with the rear face of the radiant surface.

The radiant surface may be a burner tile or a multi-ply screens (not shown) that define a plurality of small openings which permit combustion of the air/gas mixture as it passes therethrough. A means is provided for initially sparking or igniting the mixture at the radiant surface. In the present invention a container 80 houses the pilot 82 and the igniter 84 (see FIG. 3) which provides the initial sparking. It will be appreciated that any conventional means for initially sparking or igniting the mixture can be utilized. Combustion of the air/gas mixture is maintained and reaches elevated temperatures of approximately 1200° F. The heater shown in the drawings with one propane cylinder is rated at a minimum 4000 BTUs and a maximum 9000 BTUs at eleven inches water column pressure. Other ratings are also potential alternatives, including up to 20,000 to 25,000 BTU models when more than one propane cylinder and associated burner assemblies are utilized.

A reflector 90 extends outwardly from the top of the burner plenum 72 at an angle directed toward the top portion of the front face 12 of the housing 10. The natural convective upward path of the combustion products leads the combustion products into contact with the reflector 90. The reflector 90, in addition to directing the radiant energy output from the heater toward the front surface of the housing, also acts as a deflector and reduces the temperature of the combustion products exiting the heater which greatly reduces the chance for ignition of a combustible material if it comes into contact with the heater. An outlet 92 is disposed near the top of the housing 10 allowing warm air to mix with combustion products and exit the device after contacting the reflector 90. In addition, a deflector 95 is disposed on the top of front face 12 which reduces the temperature of the combustion products exiting the heater which greatly reduces the chance for ignition of a combustible material if it comes into contact with the heater A.

In addition, there is an outlet or grate 94 disposed rearward of outlet 92 that communicates with the interior of the housing. It provides a continuous flow path for air (that does not enter the venturi) to flow from the inlet 40 around the rear of the plenum chamber and exit the housing rearward of the deflector. This enhances the chimney effect as described above since a large amount of ambient air is drawn into the housing, a portion used for combustion purposes and the remainder convects upwardly along the rear of the plenum and the deflector to exit via the openings 94. The air inlet 40 of the present invention is designed to encourage air flow along the back of the hot burner plenum 72, advantageously resulting in an increased velocity of air flow to the burner venturi, as well as cooling the rear housing 10. As the burner venturi 60 is heated, the thermal convection properties urge the air/gas mixture through the upwardly angled burner venturi 60 creating a chimney type effect. The chimney effect created by the present invention increases the fresh air flow velocity into the burner venturi, enabling the pressure from the gas supply 50 to be reduced, yet burn efficiently on high or low settings.

Figure 3:
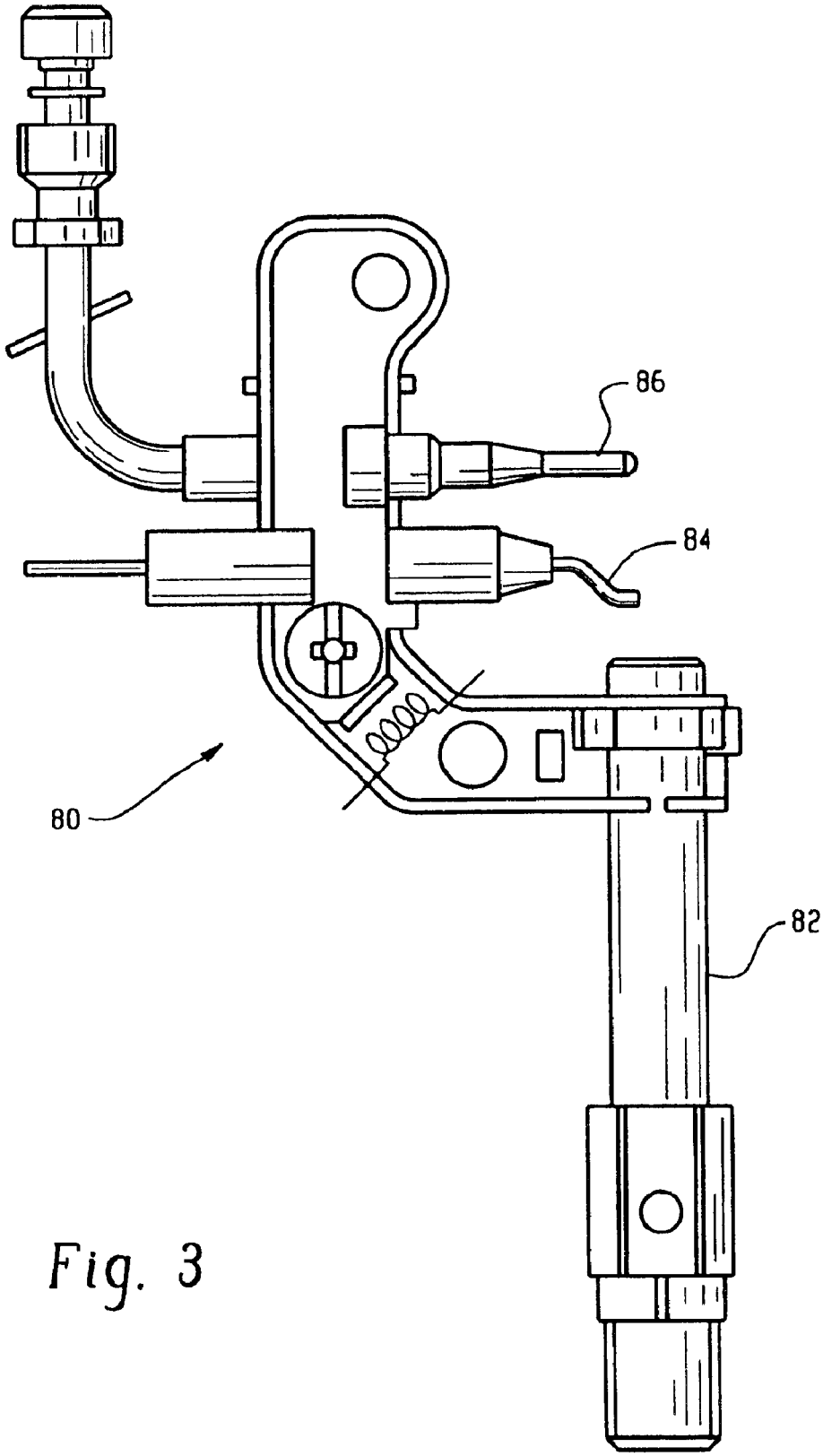
FIG. 3 is an enlarged elevational view of a thermocouple, spark igniter, and pilot tube assembly used in the preferred embodiment of the present invention.

In addition to housing the pilot 82 and the igniter 84, the container 80 preferably houses an oxygen depletion system (See FIG. 3). The oxygen depletion system (ODS) provides an automatic shutoff mechanism when decreased oxygen levels and resulting increased carbon monoxide concentrations are detected. For example, the heater of the present design is intended to automatically shut off at 100 PPM of carbon monoxide at 18% oxygen levels (21% free normal air). A thermocouple 86 monitors changes in temperature of the pilot flame which indicates changes in oxygen and carbon monoxide levels. Previous designs found in the prior art use a thermocouple/plunger type safety shut-off arrangement, which is not deemed to be as sophisticated or precise as the ODS of the present invention. The addition of an ODS to portable unvented heaters is an improvement in the art and the first of its kind. A more detailed discussion of the ODS can be found in a variety of resources.

The present invention significantly reduces the pressure from the propane tank in one stage. The pilot burner must operate at 11" water column (W.C.) while the main burner may optionally operate at this same pressure although higher pressures are envisioned. This is the first portable device for indoor use that the applicant is aware of that conforms to this standard. The portable heaters that exist today all operate at high pressures (on the order of 12 psi) and do not incorporate an ODS. In addition, the present device has the ability to pass combustion requirements at a low fire condition.

Figure 15:
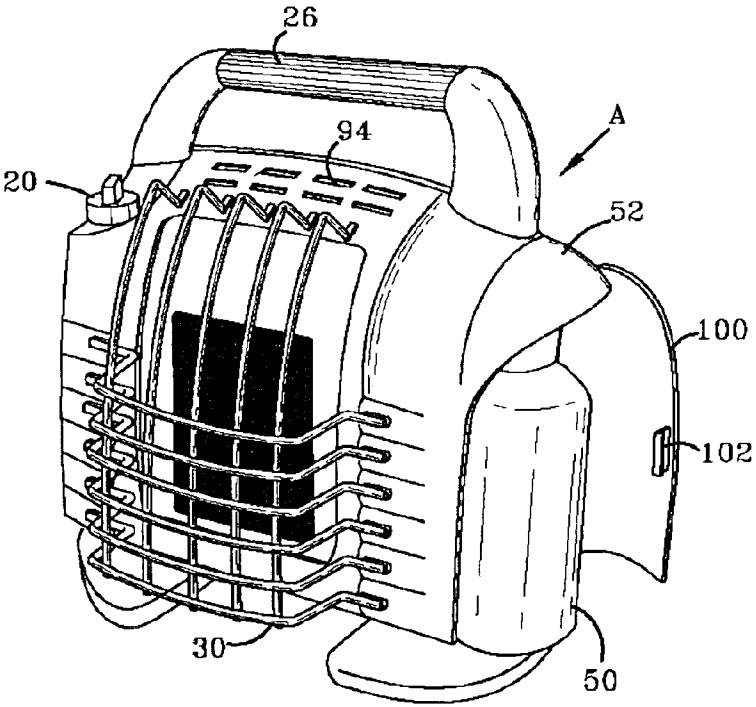
FIG. 15 is a side elevational view of the portable heater showing a fully enclosed fuel source openable by a hinged door.

In another embodiment of the invention illustrated in FIG. 15, the fuel source is positioned within housing 10 and is accessible through pivotable hinged door 100 with latch 102. Conical dome 52 extends partway down vertical side 18 and over at least a portion of the valve of fuel supply 50. Pivotal movement of hinged door 100 is accomplished by the user effecting vertical axial counterclockwise rotational movement about a pair of hinges or pivot axis (not shown) at one side of the door.

Figure 16:
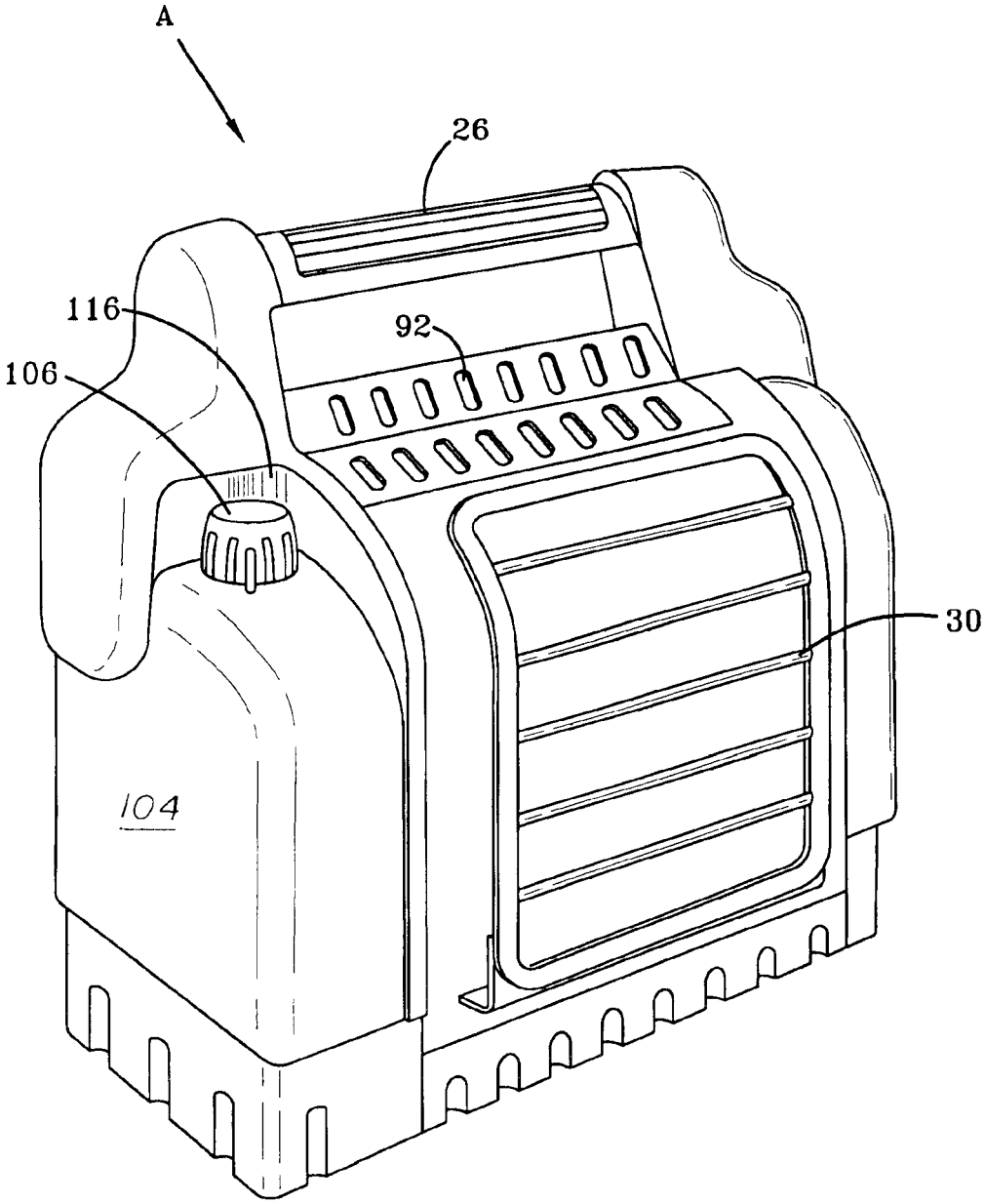
FIG. 16 is front elevational view of the portable heater showing an attached battery pack for use with an optional fan to increase circulation.
Figure 17:
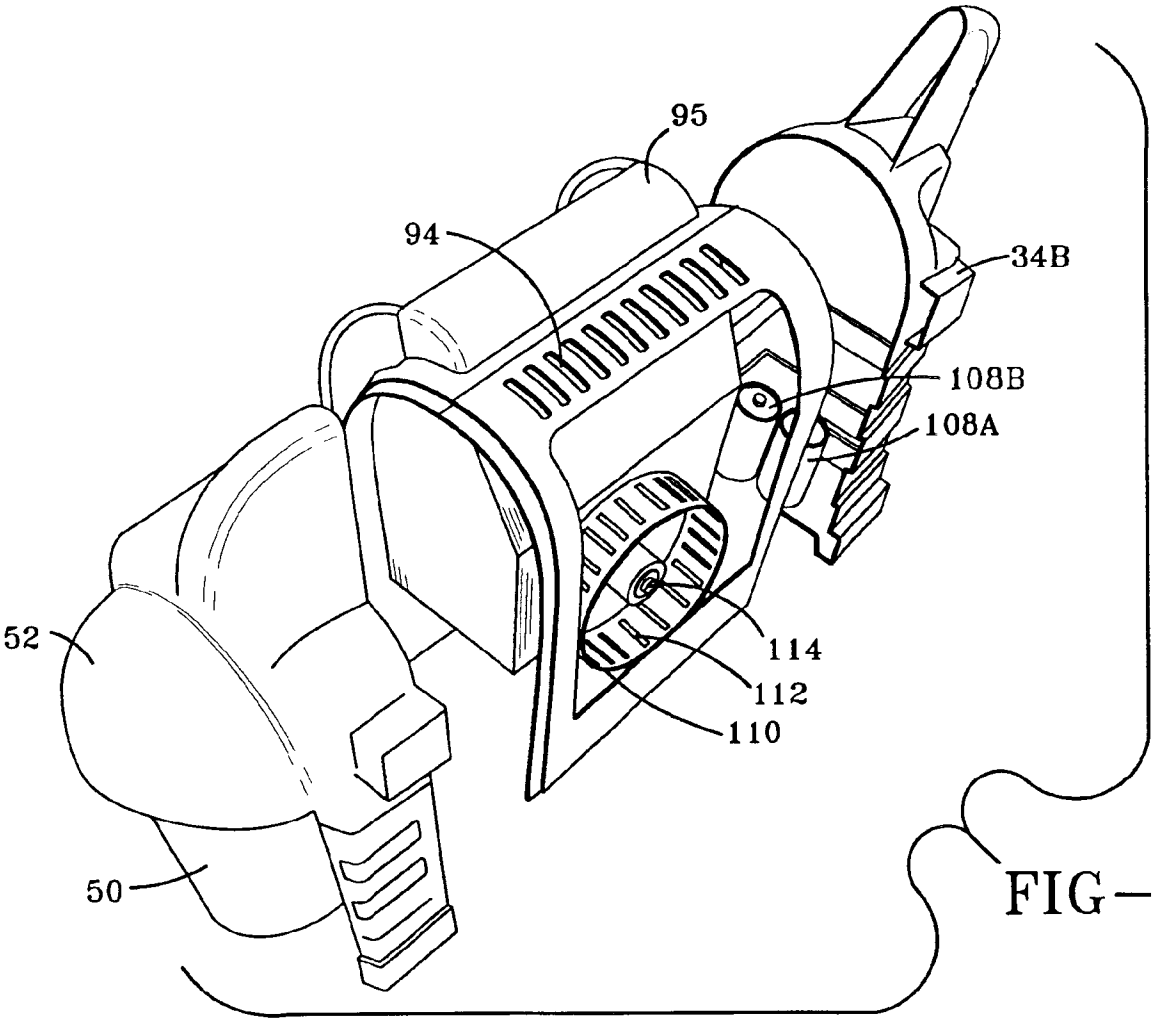
FIG. 17 is a top perspective view of the portable heater with top handle removed showing an optional rear fan in the housing operated by removable and optionally rechargeable dry cell batteries.
Figure 26:
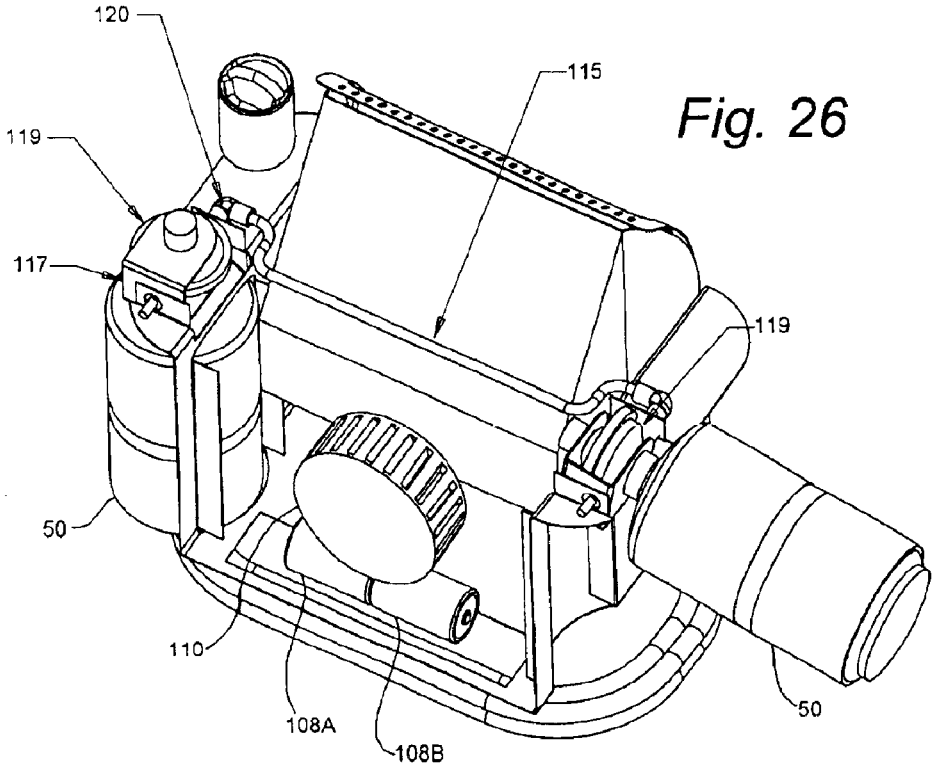
FIG. 26 is a rear perspective view with rear and side panels removed illustrating pivotable fuel source rotation and battery-powered fan.

FIG. 17 illustrates yet another embodiment of the invention in which improved air flow is effected through heater unit A by the incorporation of a paddle or cage fan 110 in back panel 14. In one aspect shown in FIG. 16, a rechargeable battery pack 104 is illustrated to be positionable within accommodating slot 116 within side panel 16 of housing 10. Knob 106 is used to variably define the power setting used with battery pack 104 as well as to be used as an "on/off" switch for controlling the speed of fan 110. Alternatively, and in another aspect of the invention, at least one, preferably two or more rechargeable dry cell batteries, 108*a*, 108*b* are employed within side panel 16 of housing 10 as better illustrated in FIG. 17. The batteries are positioned to be loaded from the bottom of housing 10 and, the power controlled by a variably positioned knob 106 located toward the front of housing 10 or at an alternative position as is known in the art for controlling variable amounts of power to an electrical device. Depending on the rotational speed of the fan desired, coupled with battery life expectancy, anywhere from one to four "C" or "D" sized batteries are employed, although it is equally envisioned that "AA" batteries may be used in some models where power consumption is envisioned to be minimal or usage infrequent and for short duration. Fan 110 has a plurality of paddles or inwardly extending panels for creating air movement through rotational pivotal movement about axis 114. The fan is typically a lower voltage fan, e.g., 3.0 volts, powered by a direct current motor. This increased air flow insures maximal cooling capacity on various metal and plastic components in heater A. Battery operation is also illustrated in FIG. 26 where an alternative dry cell location is identified.

Figure 19:
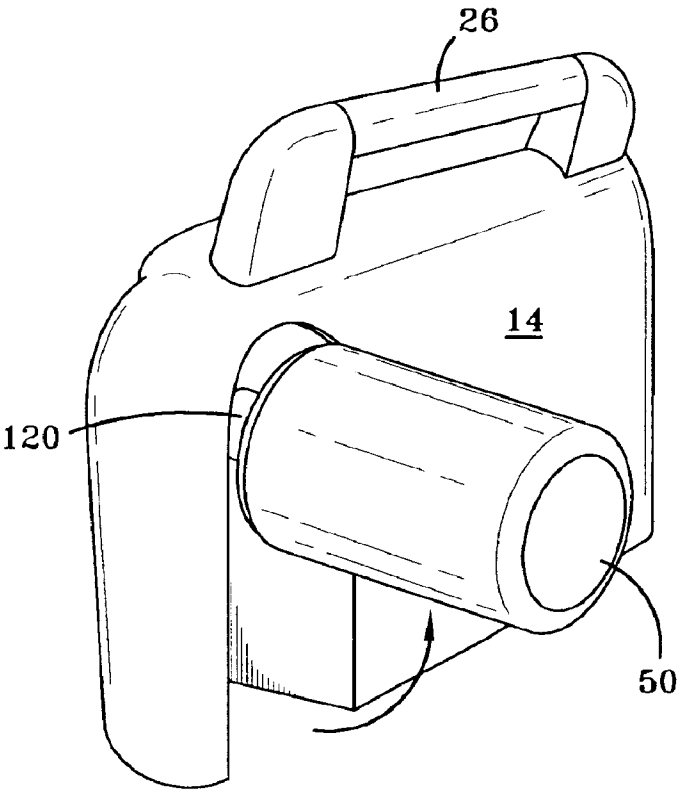
FIG. 19 is a rear elevational view of the portable heater with the detachable door of FIG. 18 removed thereby illustrating the fuel source which is pivotable about a fuel supply connection.
Figure 18:
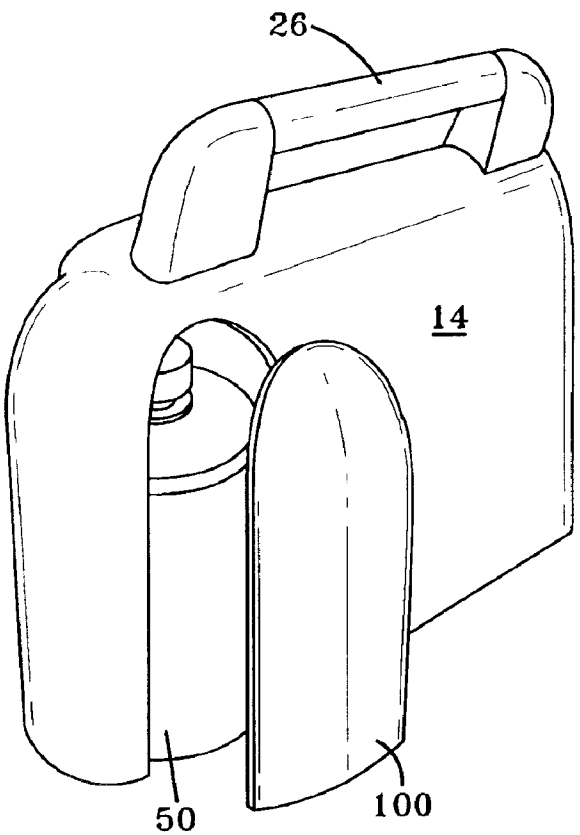
FIG. 18 is a rear elevational view of the portable heater showing a detachable door for enclosing the fuel source.

FIGS. 18–19 illustrate another embodiment of the invention in which a snap-fit door 100 is removable from side panel 18 thereby permitting pivotal rotational movement from a first position to a second replaceable position of fuel source 50 by swivel fitting 120. This configuration allows an end-user to rotate the fuel source for easier canister replacement without having to simultaneously lift the unit. This pivotal coupling is additional illustrated in FIGS. 26–27 where one fuel source 50 is shown rotated approximately 90°. Pivotal movement is effected by rotatable fuel supply connection 120 feeding common fuel line 115. Propane cylinders are secured by threading engagement with regulator 119 held in position by sheet metal bracket 117 with pivot axis.

Figure 4:
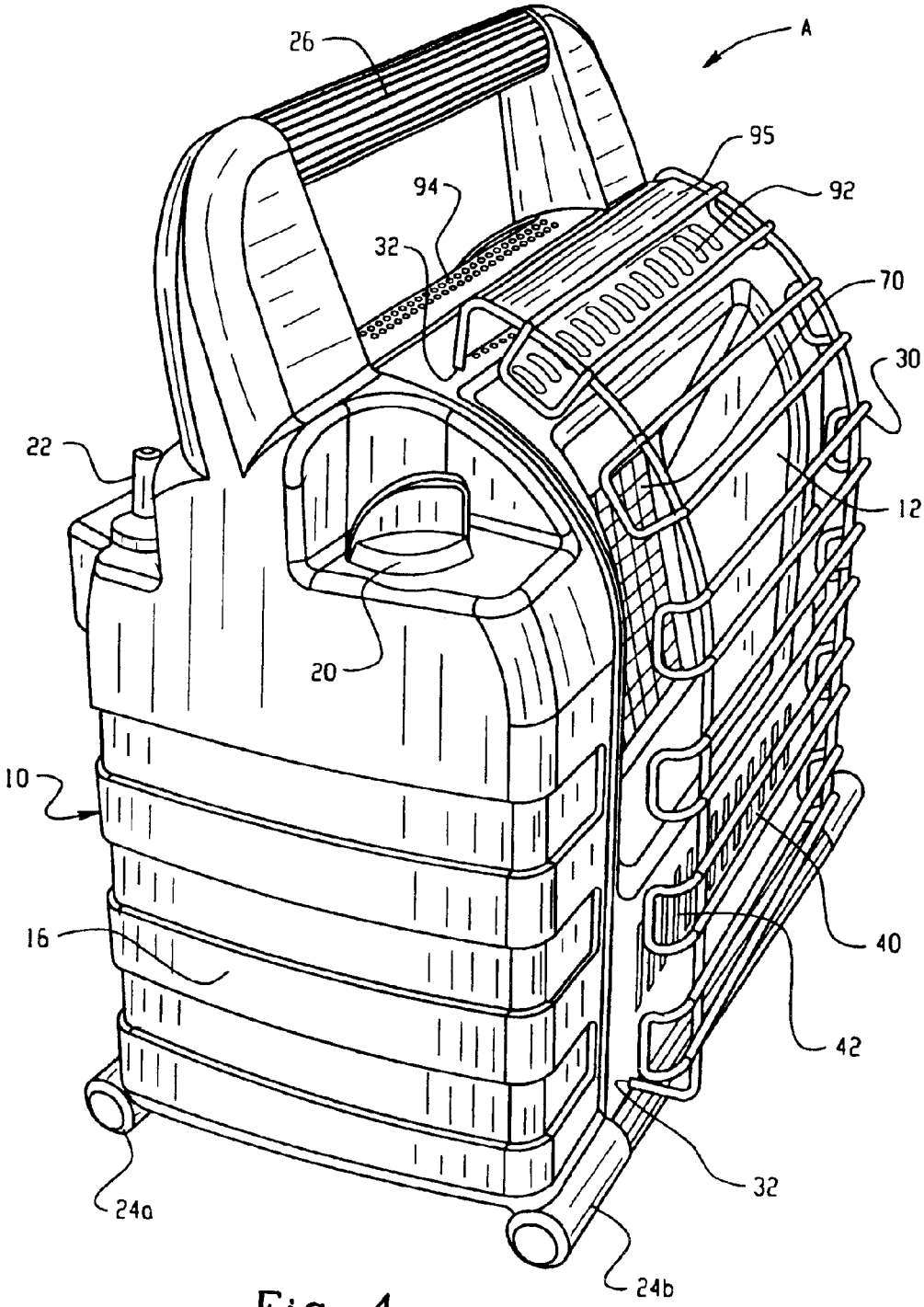
FIG. 4 is a perspective view of the heater taken generally from the front and left-hand side.
Figure 20:
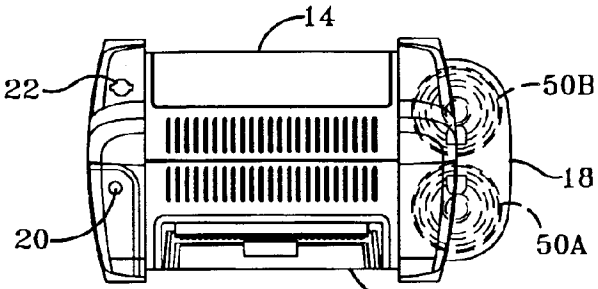
FIG. 20 is a top elevational view of the portable heater with handle and front grill removed showing two fuel sources positioned about one side of the heater.
Figure 21:
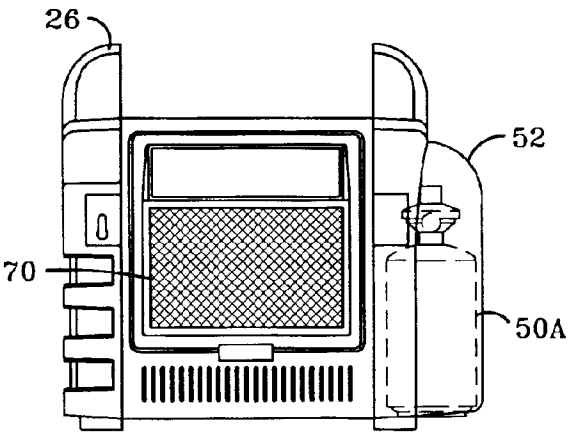
FIG. 21 is a front elevational view of the portable heater of FIG. 20 showing front fuel source in ghost lines.

FIGS. 20–27 illustrate yet another embodiment of the invention in which more than one fuel source is positionable within the housing. As illustrated in FIG. 20, two fuel sources 50*a*, 50*b* are positioned within side wall 18 and at least partially covered by dome-shaped shoulders, and in one aspect, completely enclosed therein as illustrated in FIG. 21. Temperature controller button 20 and igniter button 22 are positioned similarly to that shown previously in FIG. 4.

Figure 22:
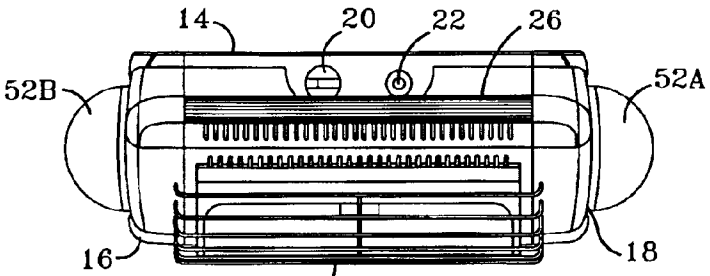
FIG. 22 is a top elevational view of an alternative embodiment of the invention illustrating two fuel sources positioned about opposed sides of the heater.
Figure 23:
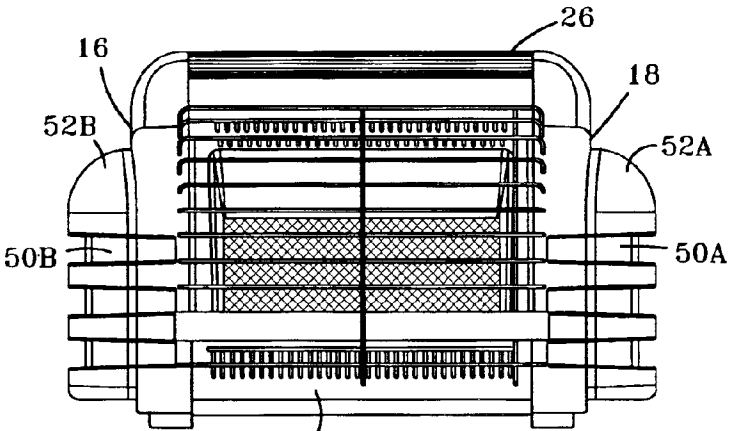
FIG. 23 is a front elevational view of FIG. 22 illustrating the fuel sources enclosed within a slotted enclosure.

In FIGS. 22–23, two fuel sources 50*a*, 50*b* which are at least partially enclosed by dome-shaped side panels 52*a*, 52*b* are positioned on opposed sides 18, 16 of heater housing 10. In this particular embodiment, the units are connected by a mixing valve (not shown) and the temperature controller button 20 and igniter button 22 operate to control a single burner unit.

Figure 24:
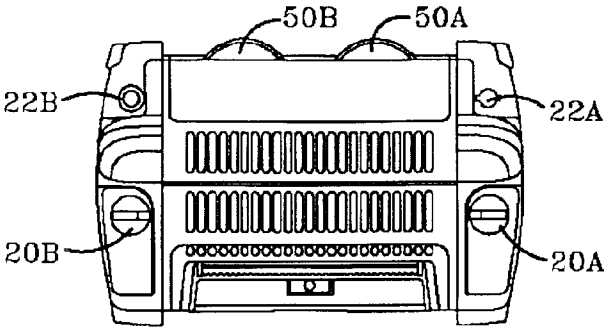
FIG. 24 is a top elevational view of an alternative embodiment of the invention with handle and front grill removed illustrating two fuel sources positioned at the rear of the heater and partially protruding through the rear wall of the heater.
Figure 25:
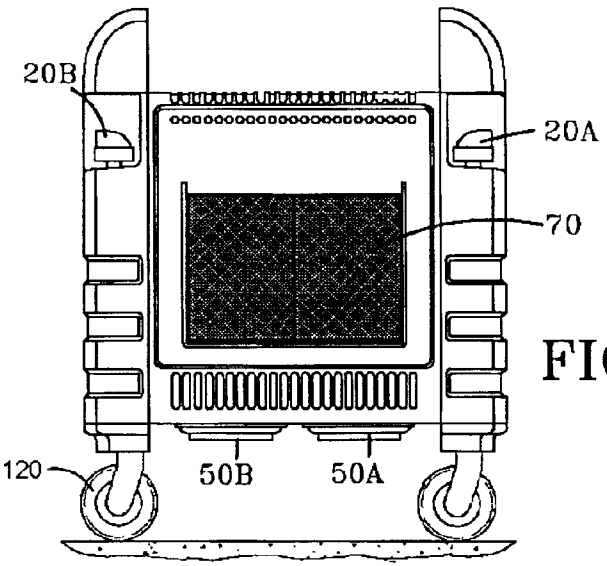
FIG. 25 is a front elevational view of FIG. 24.

In FIGS. 24–25, two fuel sources 50*a*, 50*b* are once again shown, the canisters protruding at least partially from the rear 14 of heater housing 10. As illustrated in this embodiment, each fuel source has its individual temperature controller buttons 20*a*, 20*b* and igniter buttons 22*a*, 22*b* for controlling the temperature of heater A.

It is recognized that when dual fuel source applications are discussed, it is recognized that the heat capacity of each burner need not be the same, and it is within the scope of this invention that different capacity burners are envisioned. For maximum heat control by the end-user, it is within the scope of the invention that one burner will be for "low" capacity applications and wherein the second burner will be for "high" capacity applications, and wherein the two burners can be used in combination to produce yet a higher capacity unit. For other applications, there will be two "low" capacity burners employed within one unit as well as applications where there will be two "high" capacity burners employed within the same unit. In a more expensive version of the heater, two continuously variable burners will be employed, such variability predicated by the rate at which fuel and/or air is supplied to the burners as well as the capacity of the burners.

It should be noted that in embodiments of this invention in which more than one fuel source is illustrated, that the fuel sources can either be operated in tandem or individually. When operated in tandem, a mixing valve is included prior to the burner. In some embodiments of the invention, the second location of the fuel source is that of a storage capacity only, and the unit operates as previously described. It should also be noted that the handle 26 illustrated in many of the embodiments, is often optional, and that a heater which achieves portability by the incorporation of wheels 120 positioned at the bottom of the unit, better illustrated in FIG. 25 is within the scope of this invention or wherein the portability is associated with the incorporation of a wheeled dolly-like apparatus. When the wheels are of fairly small size, the number of wheels is at least three, preferably 4 and they are pivotable about a vertical axis. When the number is three, the wheels are positioned in a triangular fashion with two wheels at opposed ends on one side, and a third wheel in the middle of the unit on an opposed side. When the number is four, the wheels are positioned at the vertices of the base of the unit. In a specialized configuration, the number of wheels can be reduced to two. When used in this manner, the wheels are more similar to rollers and occupy at least 50% of the width of the base, preferably more and extending essentially across a complete side, on both sides of the unit.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

This invention has been described in detail with reference to specific embodiments thereof, including the respective best modes for carrying out each embodiment. It shall be understood that these illustrations are by way of example and not by way of limitation.

What is claimed is:

1. A portable gas-fired infrared heater comprising:

(a) a housing enclosing a burner assembly including a gas valve adapted to receive fuel from an associated fuel supply and communicating with an orifice, the orifice being located to direct fuel to a venturi for mixing with air which, in turn, communicates with a rear face of a radiant surface where combustion occurs, the housing further including an air inlet for communicating air to the venturi;

(b) said housing at least partially enclosing at least one fuel source; and (c) an oxygen depletion monitoring means inside the housing of said heater having a thermocouple which monitors the temperature of a flame operatively associated with the burner assembly for automatically shutting off the burner assembly at a predetermined content of at least one gas selected from the group consisting of oxygen, carbon dioxide and carbon monoxide.

2. The portable heater of claim 1 which further comprises (a) a handle spaced from the radiant surface.

3. The portable heater of claim 2 which further comprises (a) at least two legs that elevate the housing relative to an associated support surface.

4. The portable heater of claim 2 which further comprises (a) at least one recess in the housing for hanging the heater.

5. The portable heater of claim 4 wherein (a) the recess is a key-shaped opening.

6. The portable heater of claim 4 wherein (a) the recess is located on a surface of the housing spaced from the radiant surface.

7. The portable heater of claim 1 which further comprises (a) an igniter secured to the housing for initiating combustion at the radiant surface.

8. The portable heater of claim 1 wherein (a) the housing is dimensioned to enclose at least an upper portion of said at least one fuel source.

9. The portable heater of claim 8 wherein (a) said at least one fuel source is at least a one pound propane fuel tank.

10. The portable heater of claim 9 wherein (a) said at least one fuel source is at least two one pound propane fuel tanks.

11. The portable heater of claim 10 wherein (a) said at least two one pound propane fuel tanks are completely enclosed within said housing.

12. The portable heater of claim 10 wherein (a) said at least two fuel sources are positioned on one side of said heater.

13. The portable heater of claim 10 wherein (a) said at least two fuel sources are positioned on a rear side of said heater.

14. The portable heater of claim 10 wherein (a) said at least two fuel sources are positioned on opposed sides of said heater.

15. The portable heater of claim 10 which further comprises (a) an igniter for each fuel source.

16. The portable heater of claim 15 which further comprises (a) a controller for each fuel source.

17. The portable heater of claim 8 wherein (a) said at least one fuel source is completely enclosed within said housing.

18. The portable heater of claim 1 which further comprises (a) a controller for selectively switching operation of the portable heater among at least discrete off, pilot, low, and high positions.

19. The portable heater of claim 18 wherein (a) the controller includes a control knob disposed in a housing recess for protecting against inadvertent contact.

20. The portable heater of claim 18 which further comprises (a) a piezo igniter.

21. The portable heater of claim 1 which further comprises (a) a controller for continuous variable operation of the portable heater.

22. The portable heater of claim 1 which further comprises (a) an extended length hose assembly for connecting the heater to an associated remote fuel source.

23. The portable heater of claim 22 which further comprises (a) a hose assembly recoil means.

24. The portable heater of claim 23 wherein (a) the hose assembly further comprises a positive fuel shutoff means at both ends of said hose assembly.

25. The portable heater of claim 1 which further comprises (a) a swivel regulator for reducing pressure from an associated fuel source.

26. The portable heater of claim 25 wherein (a) the regulator limits the pressure of an associated fuel source to approximately eleven inches water column.

27. The portable heater of claim 1 wherein (a) said thermocouple monitors changes in temperature of a pilot flame associated with the radiant surface.

28. The portable heater of claim 1 which further comprises (a) a shield secured to the housing in overlapping relation to the radiant surface.

29. The portable heater of claim 1 which further comprises (a) at least one fan to increase air circulation through said heater; and (b) a power source for said at least one fan.

30. The portable heater of claim 29 wherein (a) said power source is selected from the group consisting of at least one dry cell battery, at least one battery pack and a power cord configured to plug into a source of electricity.

31. The portable heater of claim 30 wherein (a) said power source is rechargeable.

32. The portable heater of claim 1 which further comprises (a) an access means to said at least one fuel source.

33. The portable heater of claim 32 wherein (a) said access means is a door in said housing.

34. The portable heater of claim 1 which further comprises (a) at least one pivotable fitting for connection to a regulator for said at least one fuel source.

35. The portable heater of claim 1 which further comprises (a) at least two wheels extending from a bottom of said housing.

36. The portable heater of claim 35 wherein (a) said at least two wheels is four wheels, each positioned at a corner of said bottom housing.

37. The portable heater of claim 1 which further comprises (a) at least two burner assemblies.

38. The portable heater of claim 37 wherein (a) said at least two burner assemblies are independently controlled.

39. A portable radiant heater comprising:

(a) a housing having a handle for transporting the heater;

(b) an air inlet in the housing;

(c) a burner assembly mounted in the housing including at least one fuel valve adapted to operatively communicate with at least one associated fuel source and the air inlet; and (d) a radiant surface having a rear face communicating with a plenum chamber and wherein the radiant surface is recessed in the housing and disposed at an angle; and (e) an oxygen depletion system inside the housing of said heater having a thermocouple which monitors the temperature of a flame and operatively associated with the burner assembly for automatically shutting off the fuel valve in response to detection of a predetermined level of at least one gas selected from the group consisting of oxygen, carbon dioxide and carbon monoxide.

40. The portable heater of claim 39 wherein (a) the plenum chamber is adjacent to the radiant surface for distributing an associated air/fuel mixture over the rear face of the radiant surface.

41. The portable heater of claim 40 which further comprises (a) a regulator for limiting the pressure of the associated fuel source to approximately eleven inches water column.

42. The portable heater of claim 41 which further comprises (a) a control knob for selecting various modes of operation of the heater, the control knob located in a recess of the housing for limiting inadvertent contact.

43. The portable heater of claim 42 wherein (a) the heater includes a controller for providing at least 4000 BTUs/hour in a first operative state and at least 9000 BTUs/hour in a second operative state.

44. The portable heater of claim 43 which further comprises (a) an elongated hose assembly for interconnecting the heater to an associated remotely located fuel source.

45. The portable heater of claim 44 which further comprises (a) a hose assembly recoil means.

46. The portable heater of claim 45 wherein (a) the hose assembly further comprises a positive fuel shutoff means at both ends of said hose assembly.

47. The portable heater of claim 39 wherein (a) the housing includes at least one cavity dimensioned for receiving at least one associated fuel source therein.

48. The portable heater of claim 39 which further comprises (a) a venturi interposed between the at least one fuel valve and the radiant surface for mixing the associated fuel with air.

49. The portable heater of claim 39 wherein (a) said at least one fuel source is a one pound propane cylinder.

50. The portable heater of claim 49 wherein (a) said at least one fuel source is at least two one pound propane cylinders.

51. The portable heater of claim 50 wherein (a) said at least two fuel sources are positioned on one side of said heater.

52. The portable heater of claim 50 wherein (a) said at least two fuel sources are positioned on a rear side of said heater.

53. The portable heater of claim 50 wherein (a) said at least two fuel sources are positioned on opposed sides of said heater.

54. The portable heater of claim 50 which further comprises (a) an igniter for each fuel source.

55. The portable heater of claim 54 which further comprises (a) a controller for each fuel source.

56. The portable heater of claim 39 wherein (a) said thermocouple monitors changes in temperature of a pilot flame associated with the radiant surface.

57. The portable heater of claim 39 which further comprises (a) a shield secured to the housing in overlapping relation to the radiant surface.

58. The portable heater of claim 39 which further comprises (a) at least one fan to increase air circulation through said heater; and (b) a power source for said at least one fan.

59. The portable heater of claim 58 wherein (a) said power source is selected from the group consisting of at least one dry cell battery, at least one battery pack and a power cord configured to plug into a source of electricity.

60. The portable heater of claim 59 wherein (a) said power source is rechargable.

61. The portable heater of claim 39 which further comprises (a) an access means to said at least one fuel source.

62. The portable heater of claim 61 wherein (a) said access means is a door in said housing.

63. The portable heater of claim 39 which further comprises (a) at least one pivotable fitting for connection to a regulator for said at least one fuel source.

64. The portable heater of claim 39 which further comprises (a) at least two wheels extending from a bottom of said housing.

65. The portable heater of claim 64 wherein (a) said at least two wheels is four wheels, each positioned at a corner of said bottom housing.

66. The portable heater of claim 39 which further comprises (a) at least two burner assemblies.

67. The portable heater of claim 66 wherein (a) said at least two burner assemblies are independently controlled.

68. A portable radiant heater comprising:

(a) a housing for enclosing said heater and at least partially enclosing at least a one pound fuel source;

(b) an air inlet in the housing;

(c) a burner assembly mounted in the housing including a fuel valve adapted to operatively communicate with said at least one fuel source and the air inlet;

(d) a radiant surface having a rear face communicating with a plenum chamber and wherein the radiant surface is recessed in the housing and disposed at an angle; and (e) an automatic shutoff mechanism inside the housing of said heater having a thermocouple which monitors the temperature of a flame and operatively associated with the burner assembly for shutting off the fuel valve in response to a detection of a predetermined level of at least one gas selected from the group consisting of oxygen, carbon dioxide and carbon monoxide.

69. The portable radiant heater of claim 68 wherein (a) the automatic shutoff mechanism monitors changes in a temperature of a pilot flame of the burner assembly indicative of changes in the concentration of a gas selected from the group consisting of oxygen, carbon dioxide and carbon monoxide.

70. The portable radiant heater of claim 69 wherein (a) the automatic shutoff mechanism shuts off at approximately 100 ppm of carbon monoxide at approximately 18% oxygen levels.

71. The portable heater of claim 68 further comprises (a) an igniter secured to the housing for initiating combustion at the radiant surface.

72. The portable heater of claim 68 wherein (a) the housing is dimensioned to enclose at least an upper portion of said at least one fuel source.

73. The portable heater of claim 72 wherein (a) said at least one fuel source is at least a one pound propane fuel tank.

74. The portable heater of claim 73 wherein (a) said at least one fuel source is completely enclosed within said housing.

75. The portable heater of claim 72 wherein (a) said at least one fuel source is at least two one pound propane fuel tanks.

76. The portable heater of claim 74 wherein (a) said at least two one pound propane fuel tanks are completely enclosed within said housing.

77. The portable heater of claim 75 wherein (a) said at least two fuel sources are positioned on one side of said heater.

78. The portable heater of claim 75 wherein (a) said at least two fuel sources are positioned on a rear side of said heater.

79. The portable heater of claim 75 wherein (a) said at least two fuel sources are positioned on opposed sides of said heater.

80. The portable heater of claim 75 which further comprises (a) an igniter for each fuel source.

81. The portable heater of claim 80 which further comprises (a) a controller for each fuel source.

82. The portable heater of claim 68 which further comprises (a) a controller for selectively switching operation of the portable heater among at least discrete off, pilot, low, and high positions.

83. portable heater of claim 82 wherein (a) the controller includes a control knob disposed in a housing recess for protecting against inadvertent contact.

84. The portable heater of claim 82 which further comprises (a) a piezo igniter.

85. The portable heater of claim 68 which further comprises (a) a controller for continuous variable operation of the portable heater.

86. The portable heater of claim 68 which further comprises (a) an extended length hose assembly for connecting the heater to an associated remote fuel source.

87. The portable heater of claim 86 which further comprises (a) a hose assembly recoil means.

88. The portable heater of claim 87 wherein (a) the hose assembly further comprises a positive fuel shutoff means at both ends of said hose assembly.

89. The portable heater of claim 68 which further comprises (a) a regulator for reducing pressure from an associated fuel source.

90. The portable heater of claim 89 wherein (a) the regulator limits the pressure of an associated fuel source to approximately eleven inches water column.

91. The portable heater of claim 68 which further comprises (a) a thermocouple that monitors changes in temperature of a pilot flame associated with the radiant surface.

92. The portable heater of claim 68 which further comprises (a) a shield secured to the housing in overlapping relation to the radiant surface.

93. The portable heater of claim 68 which further comprises (a) at least one fan to increase air circulation through said heater; and (b) a power source for said at least one fan.

94. The portable heater of claim 93 wherein (a) said power source is selected from the group consisting of at least one dry cell battery, at least one battery pack and a power cord configured to plug into a source of electricity.

95. The portable heater of claim 94 wherein (a) said power source is rechargeable.

96. The portable heater of claim 68 which further comprises (a) an access means to said at least one fuel source.

97. The portable heater of claim 96 wherein (a) said access means is a door in said housing.

98. The portable heater of claim 97 which further comprises (a) at least one pivotable fitting for connection to a regulator for said at least one fuel source.

99. The portable heater of claim 38 which further comprises (a) at least two wheels extending from a bottom of said housing.

100. The portable heater of claim 99 wherein (a) said at least two wheels is four wheels, each positioned at a corner of said bottom housing.

101. The portable heater of claim 68 which further comprises (a) at least two burner assemblies.

102. The portable heater of claim 101 wherein (a) said at least two burner assemblies are independently controlled.

103. A portable gas-fired infrared heater comprising:

(a) a housing enclosing a burner assembly including a gas valve adapted to receive fuel from an associated enclosed fuel supply comprising at least one 1-lb. cylinder for said fuel supply and communicating with an orifice, the orifice being located to direct fuel for mixing with air which, in turn, communicates with a radiant surface where combustion occurs; and (b) an oxygen depletion monitoring means inside the housing of said heater having a thermocouple which monitors the temperature of a flame and operatively associated with the burner assembly for automatically shutting off the burner assembly at a predetermined content of at least one gas selected from the group consisting of oxygen, carbon dioxide and carbon monoxide.

104. The portable heater of claim 103 which further comprises (a) a handle spaced from the radiant surface.

105. The portable heater of claim 103 which further comprises (a) at least two legs that elevate the housing relative to an associated support surface.

106. The portable heater of claim 103 which further comprises (a) at least one recess in the housing for hanging the heater.

107. The portable heater of claim 106 wherein (a) the recess is a key-shaped opening.

108. The portable heater of claim 106 wherein (a) the recess is located on a surface of the housing spaced from the radiant surface.

109. The portable heater of claim 103 which further comprises (a) an igniter secured to the housing for initiating combustion at the radiant surface.

110. The portable heater of claim 103 wherein (a) said at least one fuel source is at least two one pound propane fuel tanks.

111. The portable heater of claim 110 wherein (a) said at least two one pound propane fuel tanks are completely enclosed within said housing.

112. The portable heater of claim 111 wherein (a) said at least two fuel sources are positioned on one side of said heater.

113. The portable heater of claim 111 wherein (a) said at least two fuel sources are positioned on a rear side of said heater.

114. The portable heater of claim 111 wherein (a) said at least two fuel sources are positioned on opposed sides of said heater.

115. The portable heater of claim 111 which further comprises (a) an igniter for each fuel source.

116. The portable heater of claim 115 which further comprises (a) a controller for each fuel source.

117. The portable heater of claim 103 which further comprises (a) a controller for selectively switching operation of the portable heater among at least discrete off, pilot, low, and high positions.

118. The portable heater of claim 117 wherein (a) the controller includes a control knob disposed in a housing recess for protecting against inadvertent contact.

119. The portable heater of claim 103 which further comprises (a) a controller for continuous variable operation of the portable heater.

120. The portable heater of claim 103 which further comprises (a) an extended length hose assembly for connecting the heater to an associated remote fuel source.

121. The portable heater of claim 120 which further comprises (a) a regulator for reducing pressure from an associated fuel source.

122. The portable heater of claim 121 wherein (a) the regulator limits the pressure of an associated fuel source to approximately eleven inches water column.

123. The portable heater of claim 103 wherein (a) said thermocouple monitors changes in temperature of a pilot flame associated with the radiant surface.

124. The portable heater of claim 103 which further comprises (a) a shield secured to the housing in overlapping relation to the radiant surface.

125. The portable heater of claim 103 which further comprises (a) at least one fan to increase air circulation through said heater; and (b) a power source for said at least one fan.

126. The portable heater of claim 125 wherein (a) said power source is selected from the group consisting of at least one dry cell battery, at least one battery pack and a power cord configured to plug into a source of electricity.

127. The portable heater of claim 126 wherein (a) said power source is rechargeable.

128. The portable heater of claim 103 which further comprises (a) an access means to said at least one fuel source.

129. The portable heater of claim 128 wherein (a) said access means is a door in said housing.

130. The portable heater of claim 128 which further comprises (a) at least one pivotable fitting for connection to a regulator for said at least one fuel source.

131. A portable radiant heater comprising:

(a) a housing for enclosing said heater (b) at least one 1-lb. fuel source in communication with said heater, said fuel source removable by pivotal movement from a first in-use position to a second replacement position;

(c) an air inlet in the housing;

(d) a burner assembly mounted in the housing including a fuel valve adapted to operatively communicate with said at least one fuel source and the air inlet;

(e) a radiant surface in the housing where combustion occurs; and (f) an automatic shutoff mechanism operatively associated with the burner assembly for shutting off the fuel valve in response to a detection of a predetermined level of at least one gas selected from the group consisting of oxygen, carbon dioxide and carbon monoxide.

132. The portable radiant heater of claim 131 wherein (a) the automatic shutoff mechanism includes a thermocouple that monitors changes in a temperature of a flame of the burner assembly indicative of changes in the concentration of a gas selected from the group consisting of oxygen, carbon dioxide and carbon monoxide.

133. The portable radiant heater of claim 132 wherein (a) the automatic shutoff mechanism shuts off at approximately 100 ppm of carbon monoxide at approximately 18% oxygen levels.

134. The portable heater of claim 131 which further comprises (a) an igniter secured to the housing for initiating combustion at the radiant surface.

135. The portable heater of claim 131 wherein (a) said at least one fuel source is at least a one pound propane fuel tank.

136. The portable heater of claim 135 wherein (a) said at least one fuel source is at least two one pound propane fuel tanks.

137. The portable heater of claim 131 which further comprises (a) a controller for selectively switching operation of the portable heater among at least discrete off, pilot, low, and high positions.

138. The portable heater of claim 131 which further comprises (a) a controller for continuous variable operation of the portable heater.

139. The portable heater of claim 137 wherein (a) the controller includes a control knob disposed in a housing recess for protecting against inadvertent contact.

140. The portable heater of claim 131 which further comprises (a) an extended length hose assembly for connecting the heater to an associated remote fuel source.

141. The portable heater of claim 140 which further comprises (a) a regulator for reducing pressure from an associated fuel source.

142. The portable heater of claim 141 wherein (a) the regulator limits the pressure of an associated fuel source to approximately eleven inches water column.

143. The portable heater of claim 131 wherein (a) said thermocouple monitors changes in temperature of a pilot flame associated with the radiant surface.

144. The portable heater of claim 131 which further comprises (a) a shield secured to the housing in overlapping relation to the radiant surface.

145. The portable heater of claim 131 which further comprises (a) an access means to said at least one fuel source.

146. The portable heater of claim 145 wherein (a) said access means is a door.

* * * * *

UNITED STATES PATENT AND TRADEMARK OFFICE

CERTIFICATE OF CORRECTION

PATENT NO. : 6,884,065 B2
APPLICATION NO. : 10/605486
DATED : April 26, 2005
INVENTOR(S) : Brian S. Vandrak, John D. DuRoss, Jr. and Allan L. Haire It is certified that error appears in the above-identified patent and that said Letters Patent is hereby corrected as shown below:

Column 13, line 62, by deleting "74" and substituting therefor --75--.

Column 15, line 13, by deleting "38" and substituting therefor --68--.

Signed and Sealed this

Twenty-seventh Day of February, 2007

JON W. DUDAS
*Director of the United States Patent and Trademark Office*